US011619041B2

(12) United States Patent
Mullaney et al.

(10) Patent No.: US 11,619,041 B2
(45) Date of Patent: Apr. 4, 2023

(54) MODULAR HOUSING SYSTEM

(71) Applicant: Lifting Point Construction Technologies Pty Ltd, Penrith (AU)

(72) Inventors: Ryan Jarvis Mullaney, Marulan (AU); James Richard Howell, Clarence Town (AU); Nicholas Bruce Mullaney, Marulan (AU)

(73) Assignee: Lifting Point Construction Technologies Pty Ltd, Penrith (AU)

( * ) Notice: Subject to any disclaimer, the term of this patent is extended or adjusted under 35 U.S.C. 154(b) by 258 days.

(21) Appl. No.: 16/756,892

(22) PCT Filed: Oct. 18, 2018

(86) PCT No.: PCT/AU2018/051134
§ 371 (c)(1),
(2) Date: Apr. 17, 2020

(87) PCT Pub. No.: WO2019/075521
PCT Pub. Date: Apr. 25, 2019

(65) Prior Publication Data

US 2021/0246648 A1 Aug. 12, 2021

(30) Foreign Application Priority Data

Oct. 18, 2017 (AU) ..... 2017904218

(51) Int. Cl.
*E04B 1/343* (2006.01)
*E04B 1/348* (2006.01)
(Continued)

(52) U.S. Cl.
CPC ..... *E04B 1/34326* (2013.01); *E04B 1/3483* (2013.01); *E04G 11/54* (2013.01);
(Continued)

(58) Field of Classification Search
CPC ..... E04B 1/34326; E04B 2001/34389; E04B 2001/34884; E04B 2001/2439; E04H 1/005; E04H 1/04; E04H 2001/1283
See application file for complete search history.

(56) References Cited

U.S. PATENT DOCUMENTS 5,983,577 A * 11/1999 Hays ..... E04B 1/24 52/693
6,119,410 A * 9/2000 Wolfe ..... E04B 7/04 52/277
(Continued)

FOREIGN PATENT DOCUMENTS

AU 2014213489 10/2015
DE 102018111460 A1 * 11/2019 ..... E04B 1/3483
(Continued)

OTHER PUBLICATIONS

International Search Report for Application No. PCT/AU2018/051134 dated Jan. 8, 2019 (6 pages).
(Continued)

*Primary Examiner* — Christine T Cajilig
(74) *Attorney, Agent, or Firm* — Michael Best & Friedrich LLP

(57) ABSTRACT

The invention is directed broadly to a modular housing system having a structural framework comprising an internal chassis as a core structural element, the internal chassis including: a first ladder frame that defines a base; four columns at least two being extendable columns; and a second ladder frame engaged to the first ladder frame via the four columns, such that at least one of a distance and an angle between the first ladder frame and the second ladder frame is adjustable to define a usable volume of the structural framework.

16 Claims, 36 Drawing Sheets

(51) Int. Cl.

| | |
|---|---|
| ***E04H 1/00*** | (2006.01) |
| ***E04H 1/04*** | (2006.01) |
| ***E04B 1/24*** | (2006.01) |
| ***E04G 11/54*** | (2006.01) |
| ***E04G 21/16*** | (2006.01) |

(52) U.S. Cl.
CPC ..... *E04G 21/16* (2013.01); *E04H 1/005* (2013.01); *E04H 1/04* (2013.01); *E04B 2001/2439* (2013.01); *E04B 2001/34389* (2013.01); *E04B 2001/34884* (2013.01)

(56) References Cited

U.S. PATENT DOCUMENTS 6,332,298 B1 * 12/2001 Bigelow ..... E04B 7/08 52/236.7
2002/0116893 A1 * 8/2002 Waldrop ..... E04B 2/7818 52/843
2013/0232887 A1 * 9/2013 Donnini ..... E04H 1/005 52/79.5
2013/0305626 A1 * 11/2013 Strickland ..... E04B 1/3442 52/79.5
2014/0000183 A1 * 1/2014 Perren ..... E04B 1/34869 52/79.5

FOREIGN PATENT DOCUMENTS

| | | | |
|---|---|---|---|
| EP | 2535470 | 12/2012 | |
| EP | 2535470 A1 * | 12/2012 | ..... E04B 1/24 |
| WO | 2011160167 | 12/2011 | |
| WO | 2013120129 | 8/2013 | |

OTHER PUBLICATIONS

International Preliminary Report on Patentability for Application No. PCT/AU2018/051134 dated Feb. 4, 2020 (35 pages).

* cited by examiner

MODULAR HOUSING SYSTEM

TECHNICAL FIELD

The invention relates to a modular housing system and a method of erecting a modular house using the modular housing system.

The invention also relates to an extendable column and a self-jacking column that can be used in combination with the modular housing system although not exclusively so.

BACKGROUND

Affordability and availability are two restrictive factors that determine whether housing can be provided and erected in areas where it is most needed. Particularly in remote areas, and areas devastated by natural disaster where access, resources and manpower may be severely limited.

The present modular housing system was conceived with these shortcomings in mind.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

SUMMARY OF THE INVENTION

In a first aspect, the invention provides a modular housing system comprising a structural framework, the framework comprising an internal chassis as a core structural element, the internal chassis including: a first ladder frame that defines a base; at least two extendable columns; and a second ladder frame engaged to the first ladder frame via the at least two extendable columns, such that at least one of a distance and an angle between the first ladder frame and the second ladder frame is adjustable. The modular housing system may further comprise exterior walls and a roof supportable by the framework.

The modular housing system may further include an external chassis comprising: a lower member and an upper member defining a plane; a pair of columns each engaged with each of the lower member and upper member to form a peripheral frame; and a plurality of cross-beams perpendicularly bisecting the plane of the peripheral frame, wherein the peripheral frame is disposed apart from the internal chassis by the plurality of cross-beams, thereby increasing a usable volume of the structural framework.

Each column of the pair of columns of the external chassis may be extendable.

The external chassis may comprise a plurality of peripheral frames, each disposed apart from the internal chassis by a plurality of cross-beams.

The external chassis may comprise a plurality of peripheral frames, each disposed apart from the internal chassis by a supplementary ladder frame.

The modular housing system may further comprise a roof panel that engages with the internal chassis wherein the internal chassis supports the roof panel in an inclined orientation relative to the second ladder frame. The roof panel may comprise the second ladder frame.

The roof panel may engage the internal chassis via the extendable columns.

At least one of the first ladder frame and the second ladder frame may support a reinforcement mesh therein for receiving a settable substrate.

Each first ladder frame, second ladder frame, extendable column, non-extendable column, roof panel, cross-beam, peripheral frame and supplementary ladder frame may be dimensioned to standardised sizes. Each first ladder frame, second ladder frame, extendable column, non-extendable column, roof panel, cross-beam, peripheral frame and supplementary ladder frame may be constructed from standardised materials and/or standardised material gauges. In this manner, a modular housing system is created, allowing a mix-and-match approach to the parts required to build myriad configurations of dwelling.

Standardised connectors and brackets facilitate the mix-and-match selection of components, allowing a builder to select components from a kit or parts and to then construct a bespoke housing structure to meet the required demand.

At least one of the first ladder frame and the second ladder frame may comprise at least one cross beam extending across the frame. The at least one cross-beam may extend across the length of the ladder frame. The at least one cross-beam may extend across the width of the ladder frame. The at least one cross-beam may be connected to supplementary cross-beams or bracing members of the ladder frame to increase the rigidity of the frame.

The at least two extendable columns may be rotatably coupled to either of the first ladder frame or the second ladder frame. The extendable columns may be connected to the first or second ladder frame via a hinge, to allow the columns to remain connected to the ladder frame and to rotate between a transportation configuration and an operative configuration. The transportation configuration defined by the extendable column disposed substantially parallel to the ladder frame. The operative configuration defined by the extendable column disposed substantially perpendicular to the ladder frame.

Opposing ends of each of the extendable columns may include an ISO block from a shipping container.

At least one of the first ladder frame and the second ladder frame may provide engagement members for forklift tines.

At least one of the first ladder frame and the second ladder frame may be provided with a plurality of apertures therein, for receiving and/or securing support beams thereto.

Each support beam may be provided with a plurality of mounting features therealong for engaging cross-beams therewith.

Each of the plurality of apertures may be evenly spaced along an outer surface of at least one of the first ladder frame and the second ladder frame.

An outer perimeter of at least one of the first ladder frame and the second ladder frame may be configured to provide a C-shape cross-section.

At least one of the support beams and the cross-beams may be configured to provide a C-shape cross-section.

At least one of the support beams and the cross-beams may be configured to provide a I-shape cross-section.

A plurality of external chassis may be arranged around the internal chassis such that the internal chassis forms a core and each of the plurality of external chassis is in contact with the core.

The modular housing system may comprise: a subsequent internal chassis combined with the internal chassis, having an external chassis disposed therebetween, such that the cross-beams of the external chassis are supported at opposing ends by the internal chassis and the subsequent internal chassis, respectively.

In some embodiments three internal chassis may be arranged in series and interconnected by a pair of external chassis disposed therebetween such that each external chassis is supported between a pair of internal chassis, to form an elongate housing structure.

A plurality of first ladder frames, a plurality of second ladder frames and four extendable columns may be constrained together by a pair of packaging frames, to form a transportable housing kit. The kit may further comprise non-extendable columns. The kit may further comprise roof panels. The kit may further comprise a plurality of upper members and lower members for constructing peripheral frames.

In some embodiments either of the first ladder frame or the second ladder frame may be rotatably connected to each of the at least two extendable columns, such that the at least two extendable columns can rotate between a transport configuration where the columns are substantially parallel to the first and second ladder frames and an operative configuration where the columns are substantially perpendicular to the first and second ladder frames.

The housing system is based around a height adjustable chassis that can be extended in situ. Supplementary structural members are built-off of the pre-fabricated internal chassis in situ for time efficient, pre-engineered construction. The chassis and all structural components of the framework may be manufactured and certified prior to transportation to the predetermined site for the modular house to be constructed, thereby removing, if not reducing, the need for certification at the construction site.

The invention further provides, a modular housing system comprising a structural framework, the framework comprising an internal chassis as a core structural element, the internal chassis including: a first ladder frame that defines a base; two pairs of extendable columns; and a second ladder frame engaged to the first ladder frame via the two pairs of extendable columns, such that both a distance and an angle between the first ladder frame and the second ladder frame is adjustable. The modular housing system may further comprise exterior walls and a roof supportable by the framework.

The second ladder frame may be pivotally engaged to each of a first pair and a second pair of the two pairs of extendable columns to enable rotation of the second ladder frame in response to an unequal extension between the first pair of extendable columns and the second pair of extendable columns, without losing engagement between the first and second ladder frame.

The first pair of extendable columns may be pivotally mounted to the second ladder frame at a first pivot level and the second pair of extendable columns are pivotally mounted to the second ladder frame at a second pivot level, wherein a distance h between the first pivot level and the second pivot level and a distance x between the first and second pair of extendable columns defines a maximum inclination angle $\theta$ of the second ladder frame, as: $\sin\theta = \text{distance } h / \text{distance } x$ A standardised central core, or internal chassis, can be linked side-by-side or on top of a subsequent core to form almost any design of structure. Outrigger frames, or external chassis, can be located to the outside of the internal chassis or core and standardised prefabricated floor and roof panels can be added including either reinforcement mesh or timber floor joist panels that can be placed and connected to each other to create an accurate base to the house, dimensioned and square, ready to construct an upper level of the structure.

Once the structural framework and floor panels are installed, standardised, locally produced cross-beams, C-channels, wall framing, utility services etc. can be installed using local contractors. Alternatively, a full construction kit can be prepared and packaged for transport to areas where local services and materials are not available.

The pivotal engagement between the second ladder frame and an upper portion of the extendable columns provides a hinge, allowing for a sloped roof to be formed, by lifting the extendable columns to different heights. This is preferable to using a hinge at a lower portion of the extendable columns, which would require the entire internal chassis to be rotated or flipped from the packaged upside-down position to an upright position to form a sloped roof profile.

The invention provides a versatile chassis that can be delivered in parts or assembled. This chassis provides a sturdy structure that can be easily built from/off using locally sourced components that in-turn may stimulate local economy. The weight and strength of the internal chassis provides a sturdy base which can be used to hold upright columns and wherein screw piles, or the like can be installed through the columns, removing the need for specialised machinery to anchor the chassis to a foundation.

The invention further provides, a modular housing system, comprising a structural framework the framework comprising an internal chassis as a core structural element, the internal chassis including: a first ladder frame defining a base; four extendable columns engaged to the first ladder frame; a second ladder frame engaged to the first ladder frame via the four extendable columns; and an intermediary ladder frame, engaged with each of the four extendable columns and disposed substantially half way between the first ladder frame and the second ladder frame, such that a first distance between the first ladder frame and the intermediary ladder frame is adjustable, and a second distance between the intermediary ladder frame and the second ladder frame is adjustable. The modular housing system may further comprise exterior walls and a roof supportable by the framework.

The modular housing system may further comprise an external chassis comprising: a lower member and an upper member and an intermediary member defining a common plane; a pair of columns each engaged with the lower member, upper member and intermediary member to form a peripheral frame; and a plurality of cross-beams perpendicularly bisecting the plane of the peripheral frame, wherein the peripheral frame is disposed apart from the internal chassis by the plurality of cross-beams, thereby increasing a usable volume of the structural framework.

The pair of columns may be extendable to provide adjustment of the lower member and the intermediary member over the first distance, and the intermediary member and the upper member over the second distance.

The modular housing system is based around a revolutionary height adjustable internal chassis, which incorporates telescopic columns on at least two of the corners of the structural framework. This allows the internal chassis to be reduced to about half the height of an ISO standard shipping container for transportation and thus facilitate two units being transported in the space of a single standard ISO shipping container. This may maximise resources and may also reduce transportation costs.

A further advantage of some embodiments of the invention is that a roof or roof structure can be fully assembled with gutters while the internal chassis is at a lowered height making it safer and quicker to install. Once the roof is in position, the extendable columns are extended to raise the roof to the required finished height.

The modular housing system has been designed for category 5, and below, cyclone rating.

The modular housing system has been designed to give the ownership of design, manufacturing and assembly back to the customer and end user, providing economic benefits and skills learning to the region of delivery. By engaging the community and individuals into the delivery processes and construction process, a feeling of pride and ownership of the product, leading to comfort and security may be provided and not just a house.

The modular housing system is intended to provide a more organic indigenous housing procurement structure, where communities can design their own home fit-outs/sizes, pitch for funding for their needs/quantities, and then construct/install their homes themselves. Allowing the communities to be included in the design and construction processes will help provide local skills development, ongoing jobs, and career opportunities, whilst providing secure and cyclone-rated housing infrastructure for indigenous people in need.

Some embodiments of the invention are directed to transportable, modular housing that can be formed from shipping containers. In some embodiments, the ISO/corner container castings from shipping containers are removed, and depending on whether international shipping requires, the ISO corner castings may not be required e.g. for locally transported and installed units. These corner castings can pose an obstacle when fitting additional components to the housing system. Furthermore, the ISO corner castings can block the passage through the columns.

The components of the modular housing system may be packaged for transportation within a pair of end frames that incorporate ISO corner castings. This enables the package to be shipped for both international and local transport; however, for most local deliveries the components of the modular housing system can be delivered without the need for the pair of end frames.

The invention further provides, an extendable column, comprising: a first hollow member and a second hollow member, wherein the second hollow member is dimensioned to sit within the first hollow member providing the column with a retracted mode in which the second hollow member is substantially disposed within the first hollow member, and an extended mode in which the second member substantially extends outwardly from the first hollow member; and a driver for driving movement of the second member relative to the first hollow member, wherein in the retracted mode the driver is packaged substantially within the second hollow member, within the first hollow member.

Each of the first hollow member and the second hollow member may comprise an upper and a lower portion, such that the upper and lower portions of the first hollow member are in contact, and the upper and lower portions of the second hollow member are in contact, when the column is in the retracted mode.

The upper portions of each of the first and second hollow members may be moved away from the respective lower portions of each of the first and second hollow members, as the driver urges the column from the retracted mode towards the extended mode.

The driver may comprise an elongate member dimensioned to be encased within the second hollow member when the extendable column is in the retracted mode.

The extendable column as described herein, wherein the driver may be configured to provide a series of teeth or a continuous thread therealong to cooperatively engage with a driving mechanism.

The driving mechanism may comprise one of a ratchet, a worm gear, a jack and an epicyclic gear set, which in cooperation with the teeth or thread of the driver moves the extendable column between the retracted mode and the extended mode.

The extendable column may further comprise a connector for operatively engaging an actuator with the driving mechanism from a primary location on an exterior of the column.

The extendable column may further comprise a supplementary connector for operatively engaging the actuator with the driving mechanism from a secondary location on the exterior of the column.

The extendable column may provide a plurality of guide members located within the extendable column to guide a path of the second hollow member relative to the first hollow member and to guide a path of the driver relative to the second hollow member.

The invention further provides, a self-jacking column for engaging a column with a foundation, comprising: a hollow support column; a shaft rotatably mounted within the support column; and a cutting member engageable at a first end of the shaft, wherein rotating motion of the shaft relative to the support column drives the cutting member into the foundation thereby drawing the shaft and attached support column towards the foundation.

The cutting member may comprise a circular flange. The circular flange may be configured as a helical thread.

The shaft may have a first end oriented towards the foundation, the first end terminating in a conical tip. The shaft may have a second end, opposing the first end, the second end configured to receive a driving mechanism to rotate the shaft.

The driving mechanism may comprise a motor for rotating the shaft within the support column. The driving mechanism may be hydraulically operated to rotate the shaft within the support column. The driving mechanism may be a handle for manually rotating the shaft within the support column.

The shaft may extend above a topmost portion of the column to expose the second end of the shaft and the driving mechanism thereon.

The support column may include an access port to facilitate engagement between the driving mechanism and the shaft therein. The cutting member may be detachable from the shaft. The cutting member may be selected in a size and material suitable for a predetermined foundation.

The self-jacking column may further comprise a lock to hold the shaft in a predetermined position relative to the column. The hollow support column may be an extendable column.

In one embodiment of the invention there is provided an adjustable pile mount, comprising: a load distribution member having an aperture therethrough and a substantially planar first surface; a locking plate having a substantially planar second surface, co-axially aligned with the load distribution member and configured such that the planar first surface of the load distribution member is in contact with the planar second surface of the locking plate; and a connector that engages the locking plate to a pile through the aperture within the load distribution member, wherein tensioning the connector draws the locking plate towards the pile and produces a clamping force between the locking plate and the load distribution member along the longitudinal axis of the connector, such that the load distribution member is free to move relative to the conjoined pile, locking plate and connector, in a plane that perpendicularly bisects the connector.

The movement of the load distribution member relative to the conjoined pile, locking plate and connector, may be limited by the dimensions of the aperture of the load distribution member.

The aperture may be configured to allow movement between the load distribution member and the locking member in a first direction on the plane that perpendicularly bisects the connector and configured to inhibit movement in a second direction on the plane that perpendicularly bisects the connector. The aperture may be circular. The adjustable pile mount may further comprise a cover.

The adjustable pile mount may further comprise a low friction coating applied to at least one of the load distribution member and the locking plate to facilitate relative movement between the first and second planar surfaces thereof.

The invention further provides, a method of erecting a modular building comprising a structural framework, the framework comprising an internal chassis as a core structural element, the method comprising the steps: (a) determining a configuration of modular house to be constructed; (b) selecting an appropriate number of internal chassis and external chassis to provide sufficient structural support for the predetermined configuration of house to be erected; and (c) arranging and subsequently interconnecting each external chassis to at least one internal chassis using a plurality of cross-beams. The modular building may further comprise exterior walls and a roof supportable by the structural framework.

The method may further comprise at least one of the following steps: (d) filing each first ladder frame of each internal chassis with a pourable substrate to form a structural floor to the modular house; (e) affixing a roof panel to each of the at least one internal chassis; (f) extending a plurality of extendable columns, disposed between a lower ladder frame and an upper ladder frame of each internal chassis, to raise the upper ladder frame to a predetermined height; (g) affixing at least one exterior wall to the modular house; (h) securing the plurality of extendable columns into a foundation of the modular house; (i) filling each extendable column with a pourable substrate; and (j) inserting a reinforcement mesh into the first ladder frame, prior to introducing the pourable substrate of step (d).

Embodiments of the modular housing system are intended to:

- Provide a quick-to-assemble structure with a sturdy core structure that additional sections can be built onto.
- Utilise local skills and local material suppliers.
- Require little or no external resources or input.
- Retain allocated funding within the community or region and stimulate the economy and growth thereof.
- Provide a basic structure that can be extended and added to in the future.
- Provide versatility to allow many designs and external wall finishes.
- Provide a modular housing system where end users can design their own buildings.
- Facilitate assembly by unskilled people.

A safety feature and advantageous feature of the modular housing system is the ability to assemble the roof and gutters or an additional level of the structure at a safe, and convenient working height, and subsequently raise the upper structure via the extendable columns once completed.

The strength of the internal and external chassis facilitates dimensional stability, thus holding the dimensions of the modular housing system stable and making the overall structure more reliable to assemble.

The modular housing system has been designed:

- to have any external walling material applied as per local customs, with bamboo, brick etc.;
- as a kit style product where a structural frame is supplied, and add-on components can be supplied by local suppliers from a standardised parts list;
- to use standardised, off-the-shelf fabricated structural components—readily available and supplied as assembled components, or regionally sourceable;
- to give ownership back to the end user and instill pride in the construction process;
- as a pre-engineered structure, certified to high standards; and
- to support regional, emerging economic growth.

Various features, aspects, and advantages of the invention will become more apparent from the following description of embodiments of the invention, along with the accompanying drawings in which like numerals represent like components.

BRIEF DESCRIPTION OF THE DRAWINGS

Embodiments of the invention are illustrated by way of example, and not by way of limitation, with reference to the accompanying drawings, of which.

The invention will now be described more fully hereinafter with reference to the accompanying drawings, in which various embodiments, although not the only possible embodiments, of the invention are shown. The invention may be embodied in many different forms and should not be construed as being limited to the embodiments described below.

DETAILED DESCRIPTION OF EMBODIMENTS

The term "chassis" is understood herein to define a frame, or skeleton to the modular house that provides a structural framework as a basis from which additional panels and members can be engaged and supported.

Figure 1A:
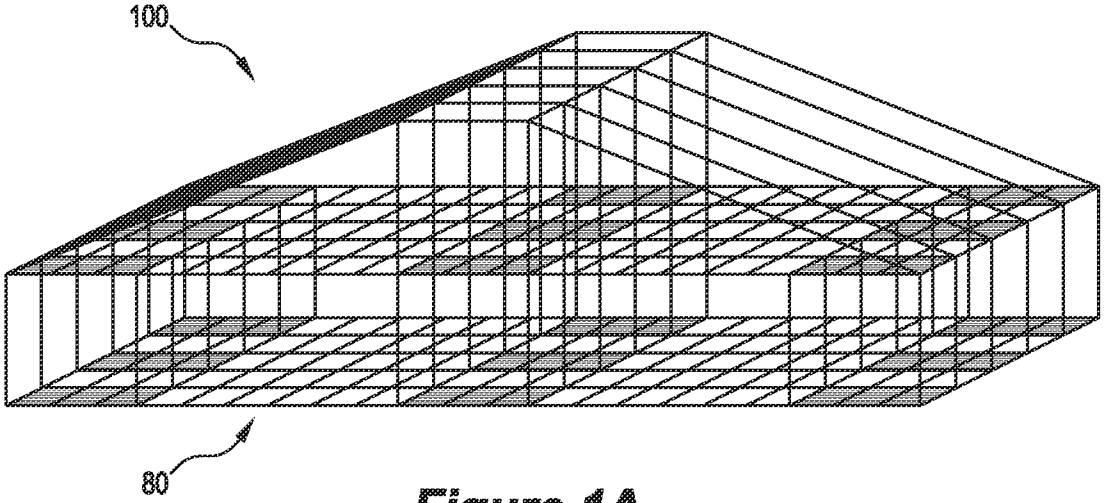
FIG. 1A is a perspective view of a structure according to an embodiment of the invention illustrating nine core units interconnected by a plurality of cross-members.
Figure 1B:
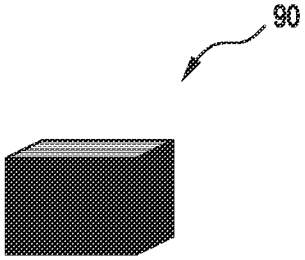
FIG. 1B is a perspective view of a transportable kit comprising members of the modular housing system for constructing the structure of FIG. 1A.
Figure 1C:
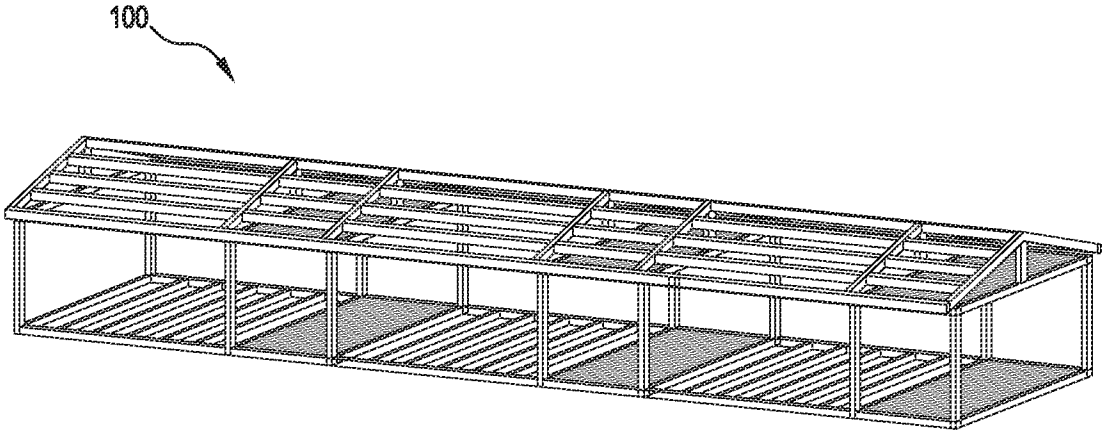
FIG. 1C is a perspective view of a structure according to an embodiment of the invention illustrating three core units interconnected by a plurality of cross-members.

Referring generally to FIGS. 1A and 1C, the invention provides a modular housing system 100 comprising a structural framework 80, the framework 80 comprising an internal chassis 10 as a core structural element, the internal chassis 10 including; a first ladder frame 12 that defines a base; at least two extendable columns 50; and a second ladder frame 14 engaged to the first ladder frame 12 via the at least two extendable columns 50, such that at least one of a distance and an angle θ between the first ladder frame 12 and the second ladder frame 14 is adjustable. In some embodiment, the modular housing further comprises a roof supported by the framework 80. In some embodiments the framework 80 is adjusted to provide a roof formed from an upper portion of the framework 80. In some embodiments, the modular housing further comprises exterior walls. While in some embodiments, the structural framework 80 can be enclosed by nets or fly-screens.

While the invention is described herein in relation to a modular housing system 100 for constructing houses, it is also contemplated that the invention is applicable to other forms of structure eg. stores, shelters, warehouses, schools, hospitals, garages, shops etc.

Figure 1D:
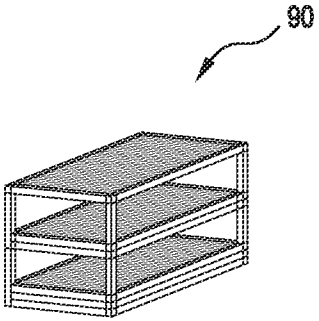
FIG. 1D is a perspective view of a transportable kit comprising members of the modular housing system for constructing the structure of FIG. 1C.

The components required to construct the structures 100 are selected from a series of standardised components that can be nested/stacked to facilitate transport to a remote location, as illustrated in FIGS. 1B and 1D. All components are produced in standard sizes to facilitate a mix-and-match philosophy that provides ultimate flexibility the size, cost and configuration of the structure to be constructed.

In combination with the internal chassis 10, there is further provided an external chassis 30 comprising: a lower member 34 and an upper member 32 defining a plane P; a pair of columns 50 each engaged with each of the lower member 34 and upper member 32 to form a peripheral frame 40; and a plurality of cross-beams 38 perpendicularly intersecting the plane P of the peripheral frame 40, wherein the peripheral frame 40 is disposed apart from the internal chassis 10 by the plurality of cross-beams 38, thereby increasing a usable volume of the structural framework 80.

Figure 25B:
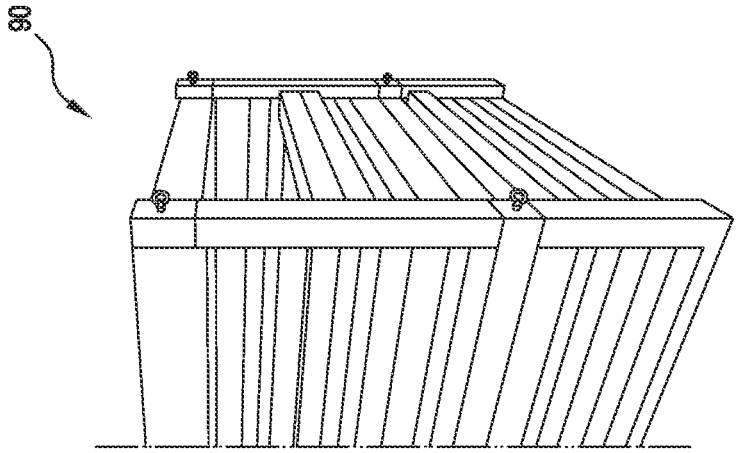
FIGS. 25A-H illustrate step-by-step a method of erecting a 3-bay house according to one embodiment of the invention
Figure 25A:
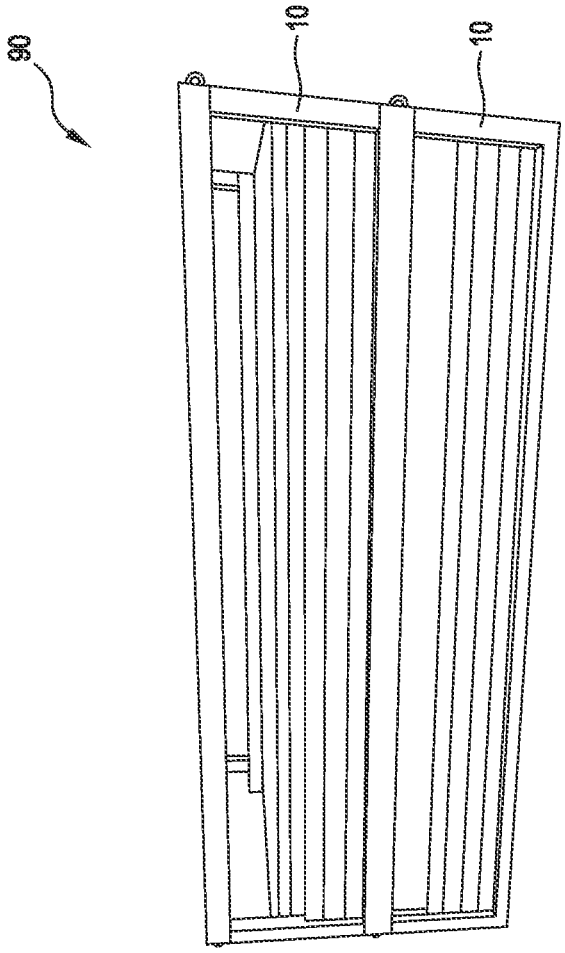
Figure 25D:
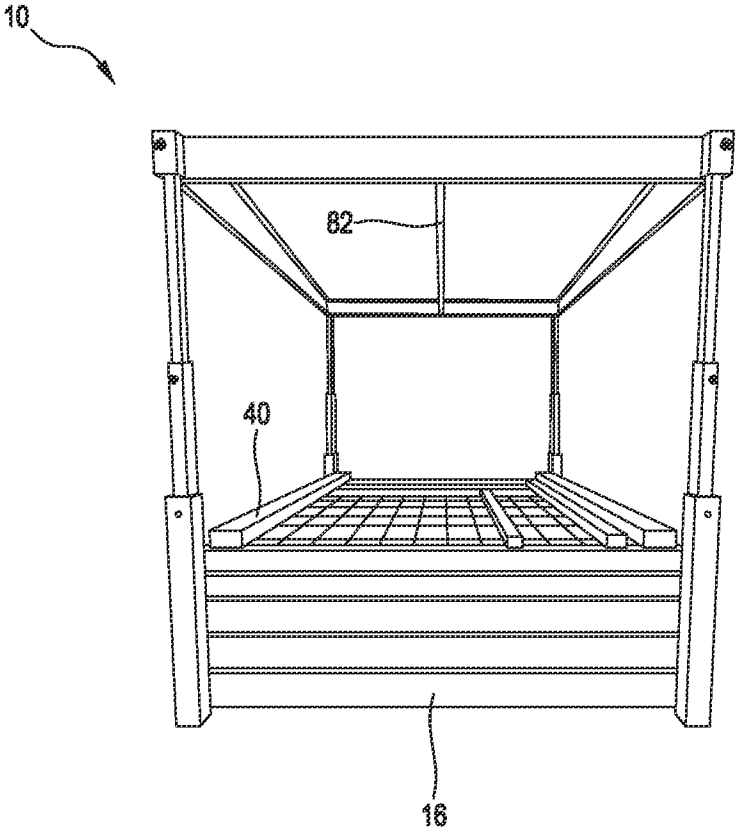
Figure 25C:
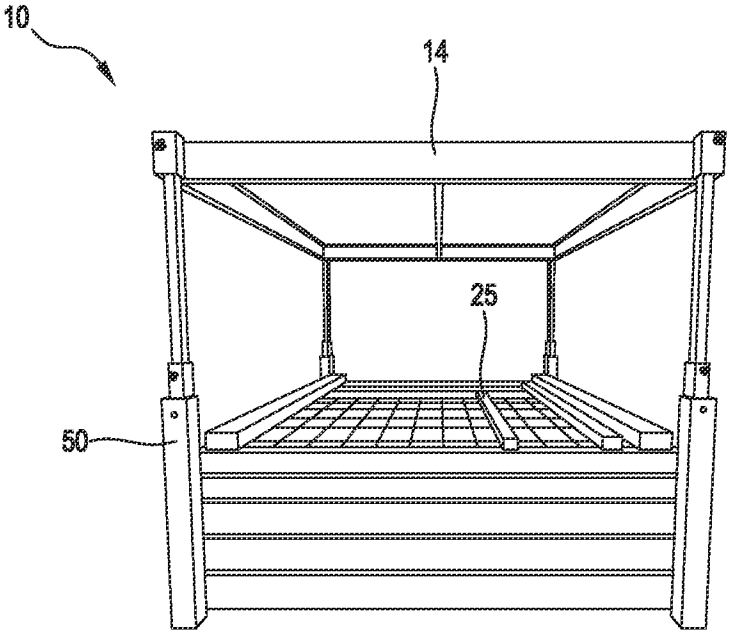
Figure 25E:
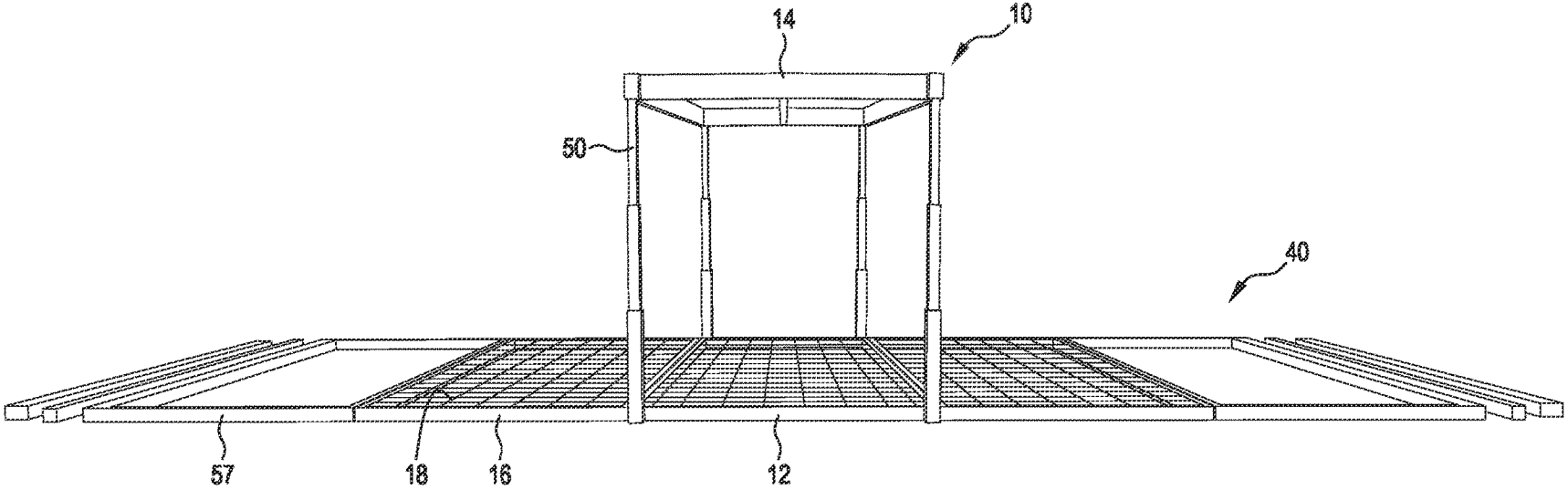
Figure 25F:
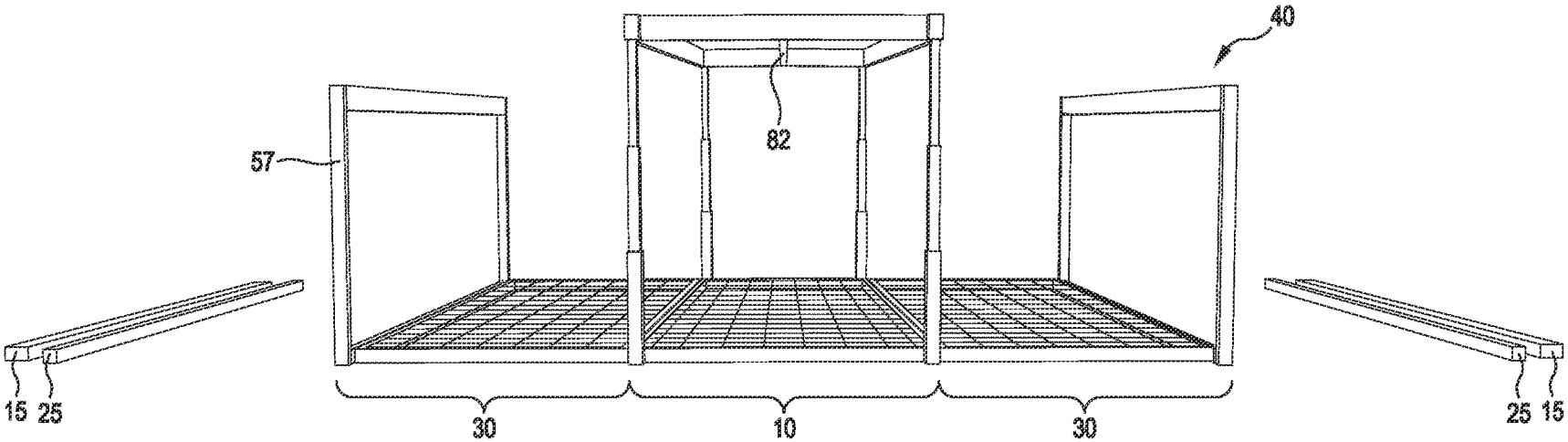

The pair of columns 50 of the external chassis 30 need not be extendable and may be fixed height columns 57, depending on the format of structure 100 to be constructed (see FIG. 25F).

Figure 2:
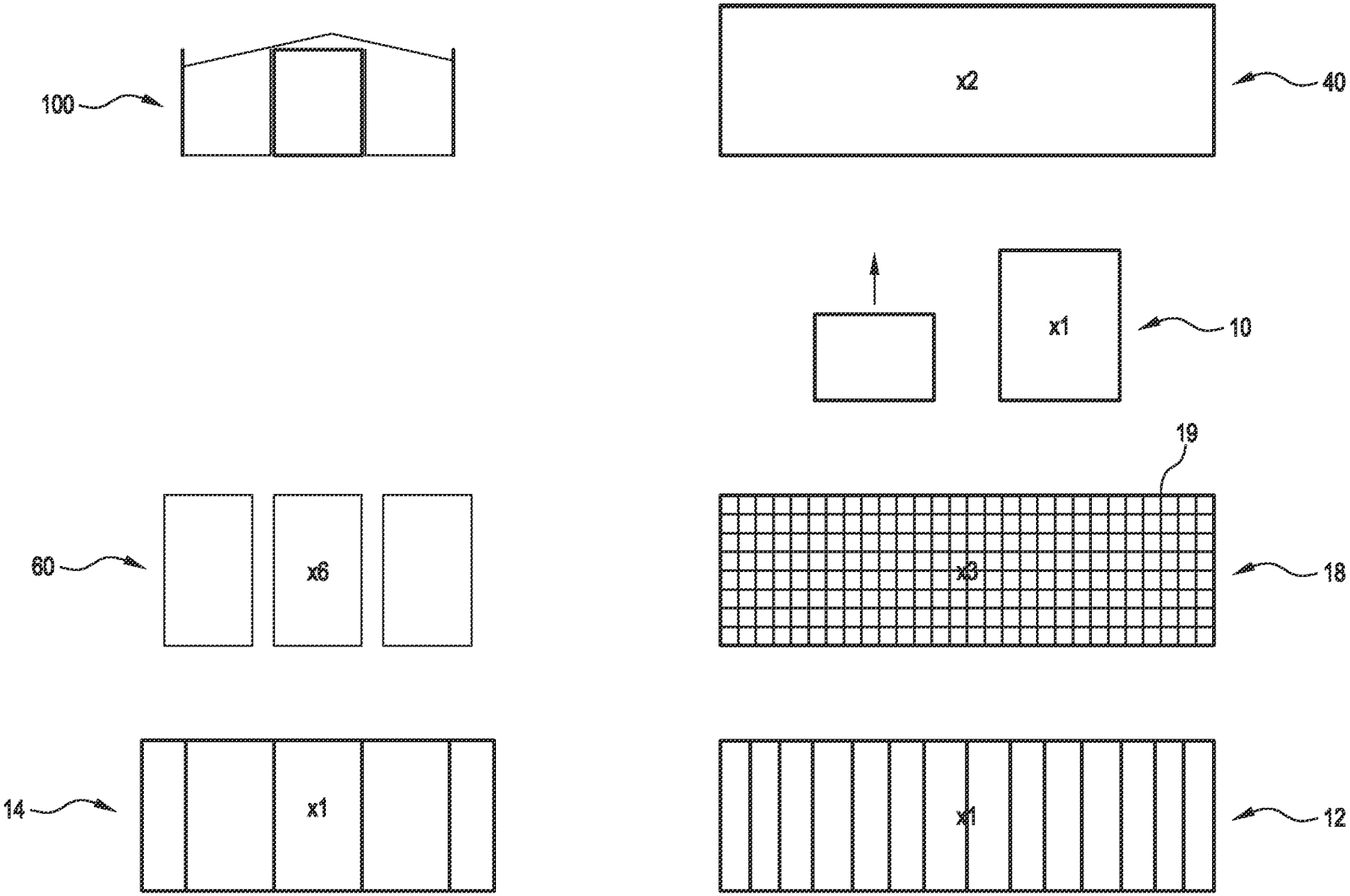
FIG. 2 is a schematic representation of a modular housing kit for constructing a structure according to one embodiment of the invention.

A schematic representation of the required kit 90 for constructing a structure according to one embodiment of the invention is illustrated in FIG. 2. In this embodiment the kit 90 provides a single internal chassis 10, consisting of a lower ladder frame 12 as a base and an upper ladder frame 14 as an upper structure and four extendable columns 50. The kit 90 further comprises a pair of peripheral frames 40, at least one reinforcement mesh 18 and a plurality of roof members 60. Once constructed the kit 90 can be used to build the house of FIG. 3A.

Figure 3C:
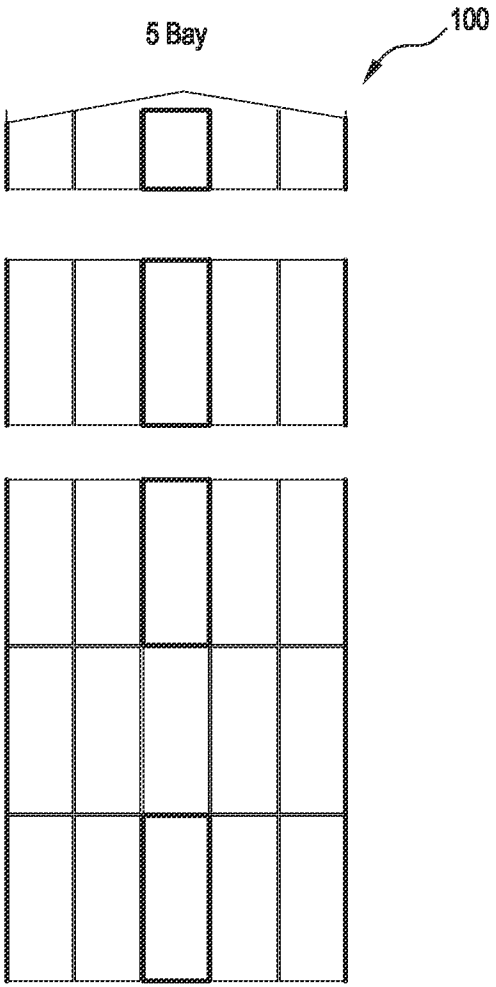
FIGS. 3A-3C illustrate schematic layouts of houses constructed from kits using one or two core units, or chassis.
Figure 3B:
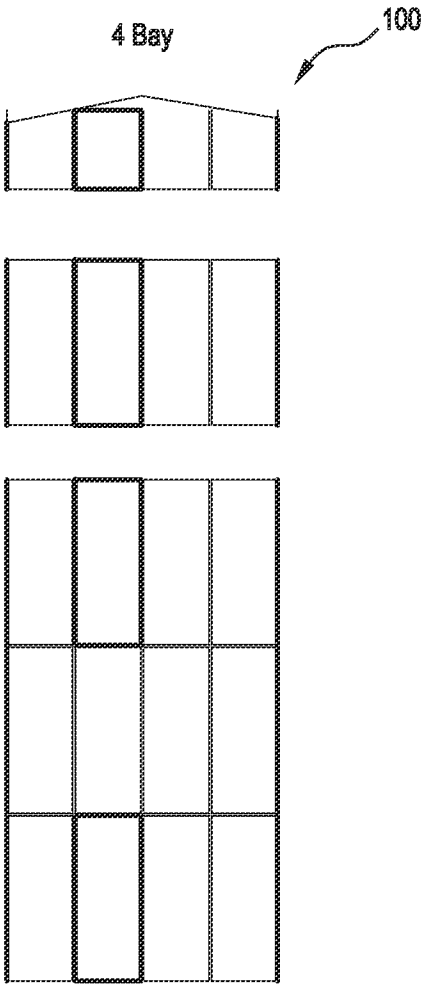

By adding additional reinforcement mesh 18 and/or additional lower ladder frames 12, and/or a series of cross-beams 38, and an additional peripheral frame 40 converts to the house of FIG. 3B to provide 4-bays.

Additional roof members 60, cross-beams 38 and/or lower ladder frames 12, and 2 additional peripheral frames 40 will extend the external chassis 30 to construct the house of FIG. 3C which provides 5-bays.

Figure 3A:
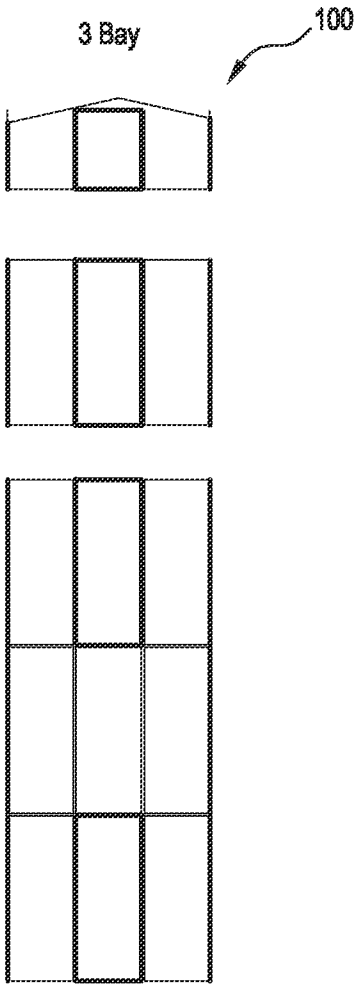

Each of FIGS. 3A-3C also maps 9-bay, 12-bay and 15-bay structures respectively, where the single internal chassis 10 format is duplicated, and the two duplicated layouts are interconnected by a series of cross-beams 38, thereby tripling the usable footprint of the house.

Structural Core—Internal or Interior Chassis 10

Figure 4:
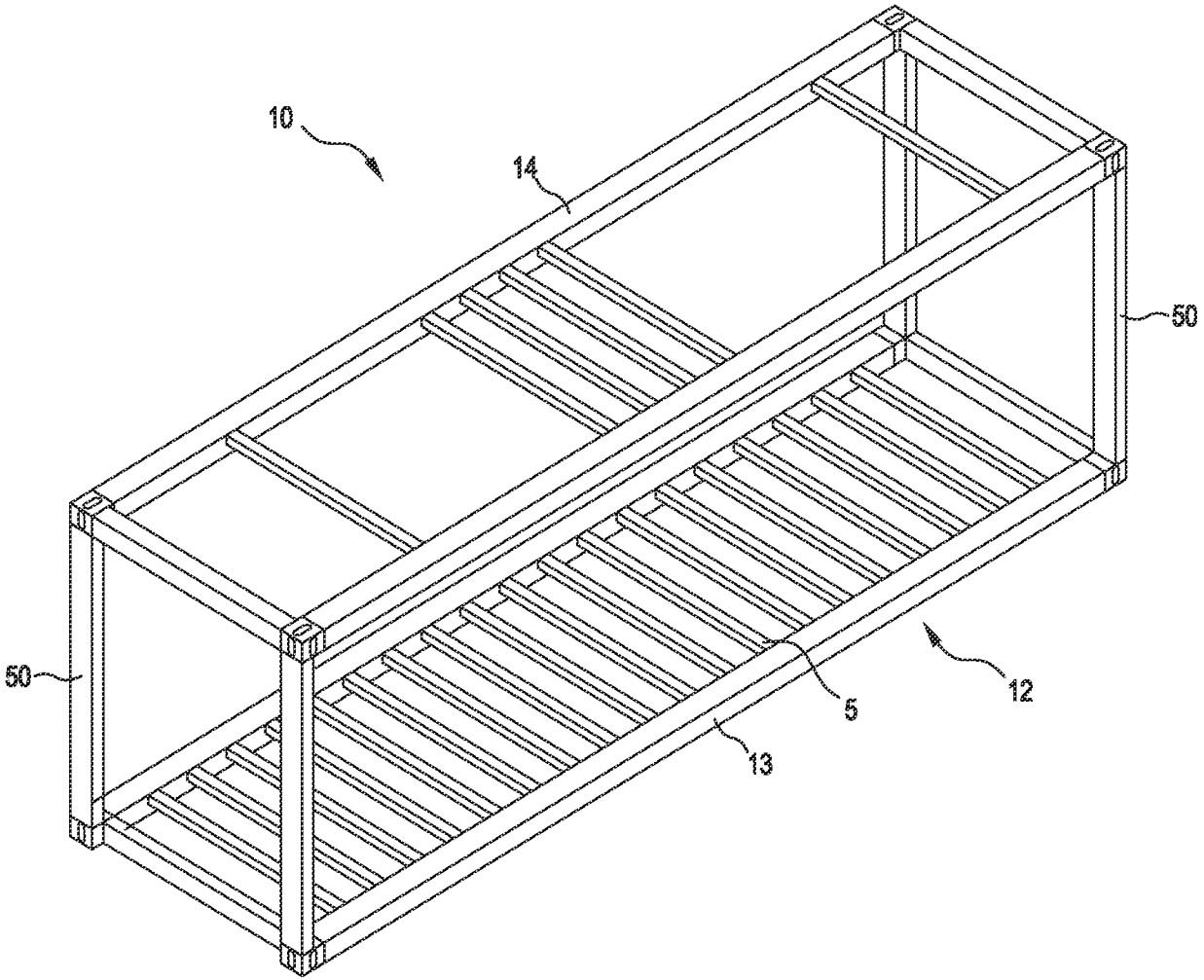
FIG. 4 is a perspective view of a core unit, or chassis according to one embodiment of the invention.

A core structure is illustrated in FIG. 4 as the internal chassis 10. The internal chassis 10 comprises a base, or first ladder frame 12, an upper or second ladder frame 14 and four extendable columns 50, located at the four corners of the first ladder frame 12.

Figure 5:
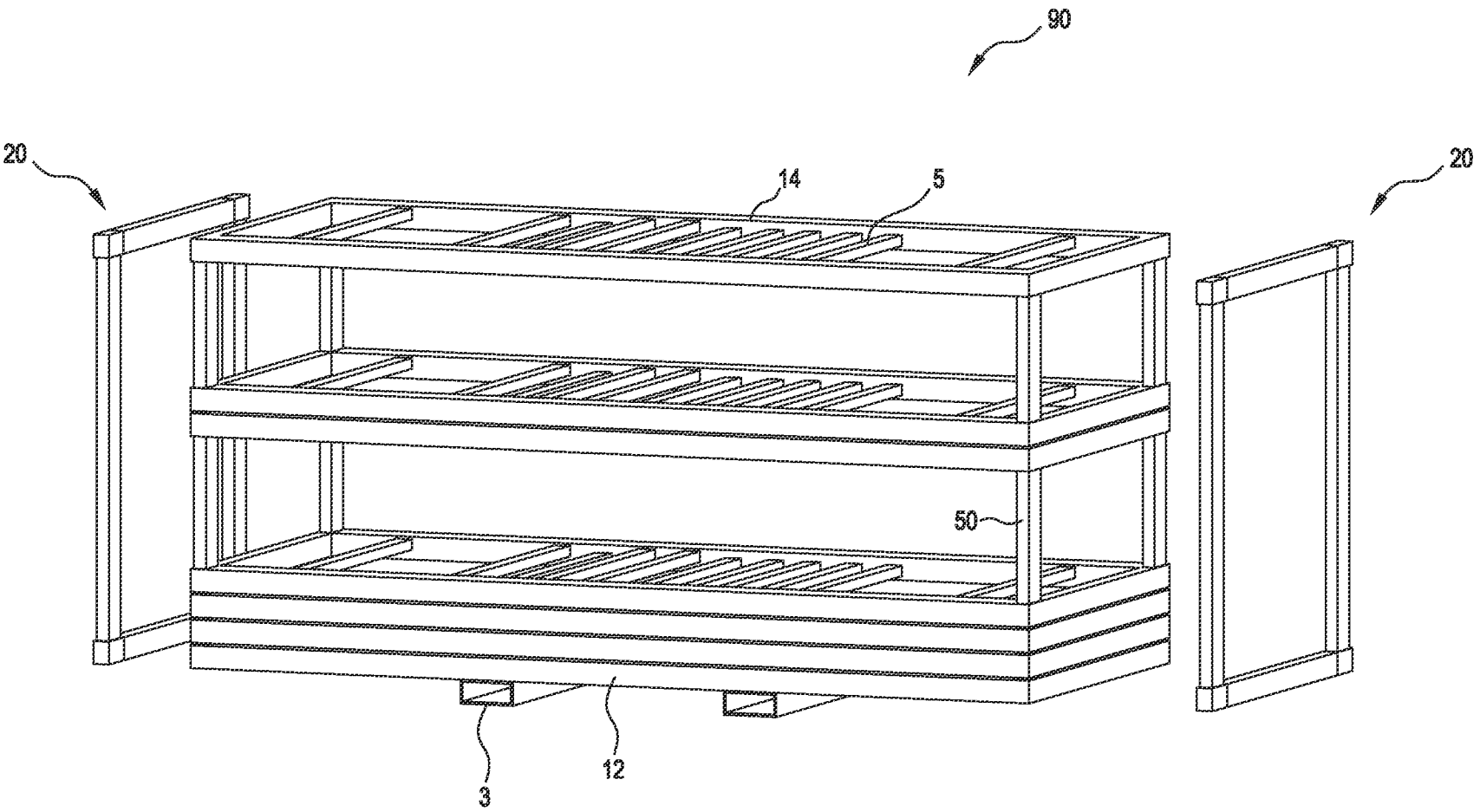
FIG. 5 is a detailed perspective view of a kit according to one embodiment of the invention configured in a transportable configuration.

A perspective view of the kit 90 is illustrated in FIG. 5, wherein the internal (or interior) chassis 10 and a plurality of additional first and second ladder frame 12, 14 are configured in a transportable configuration. A pair of end frames 20 is disposed at opposing ends of the kit 90 to secure the kit 90 for transport. When the kit 90 is secured for transport the dimensions of the kit 90 are the same as a standard ISO shipping container, to facilitate handling.

The internal chassis 10 will be able to support the structure 100 once the columns 50 are locked in position to give strength. Pourable substrates such as concrete, can be poured into the hollow extendable columns 50 to increase their load bearing capacity.

The structure 100 relies on the columns 50 for strength and not any external wall coverings or panels that can be affixed to the structure to enclose the cavity therein.

The kit 90 can be provided in a mostly assembled form and also in a fully disassembled packaged held together for transport by the pair of end frames 20.

The kit 90 can also provide portal frames (not illustrated) that can be located within the structure 100 to act as support pillars. These pillars can be cross-linked to provide additional support to the structure 100.

The wall thickness of the ladder frames 12, 14 can be varied across the frame and along the length of the frame to provide regions of increased stiffness in each frame.

In some embodiments, columns 50 are provided with covers that are installed after the structure has been raised to finished height, these column covers can add structural strength to the finished structure 100.

The Base—First Ladder Frame 12

The base of the chassis 10 is the first ladder frame 12 made from steel sections having cross-sectional dimensions of about 100 mm×50 mm and configured as C-section beams 13 at 5 mm material gauge.

A plurality of stiffening members illustrated as brace beams 5 extend across the frame 12 to add rigidity. In some embodiments the brace beams 5 extend across a major axis of the frame 12 (see FIG. 4). However, it is also contemplated that the brace beams 5 can extend across a minor axis of the frame 12. The brace beams 5 can be evenly spaced across the frame 12 or set-out with variable spacing, such that the beams 5 are closer together in areas of higher load eg. near lifting points, or forklift pockets 3. In some embodiments the brace beams 5 are configured as box sections. In some embodiment the brace beams 5 are configured as plates that extend across the frames 12 and 14.

Steel reinforcement bars joined to form a reinforcement mesh 18 to create strength. The mesh having an outer frame 19 and adapted to be inserted into the first ladder frame 12 to receive a pourable concrete. When the concrete cures, the reinforcement mesh 18 and frame 19 are combined with the concrete to create a strong durable floor 92 to the structure 100 (illustrated in FIG. 28C).

Figure 28B:
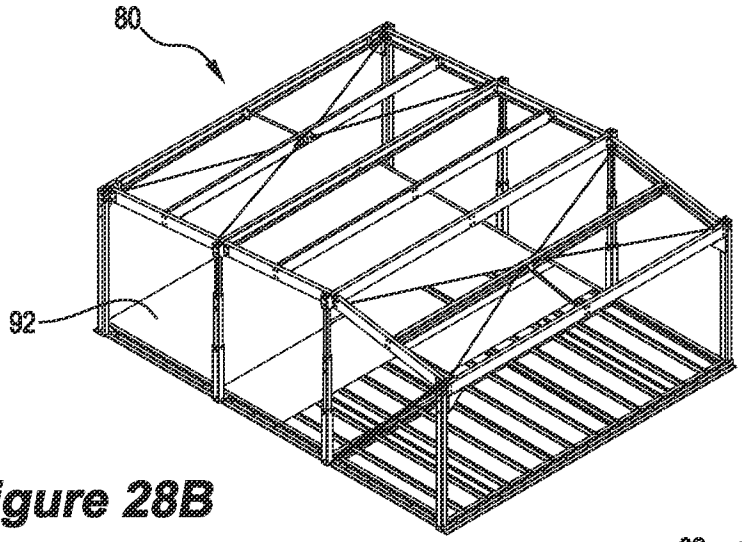
FIG. 28B illustrates a series of timber flooring sheets across the first ladder frames of the housing.
Figure 28C:
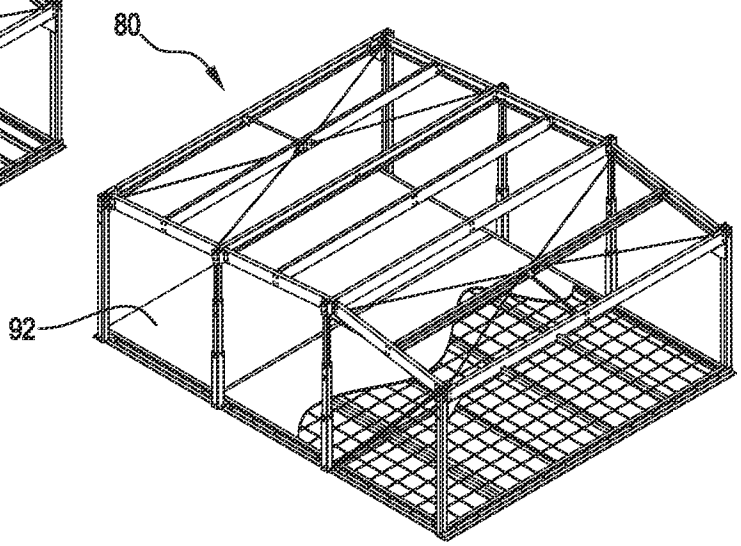
FIG. 28C illustrates a poured concrete and mesh reinforcement to provide a base to the first ladder frames of the housing.

Floor joist can be used to support a sheet floor 92 within the chassis 10 (illustrated in FIG. 28B). Alternatively, the C-section beams 13 of the first ladder frame 12 can be oriented inwardly, to support the reinforcement mesh 18 and to provide a formwork in which the concrete can cure.

Each column 50 can be welded into position in each corner of the first ladder frame 12. Alternatively, connections can be formed using sleeves provided with the kit 90.

Packaged floor frame panels combining the mesh 18 and frame 19 can be provided assembled or disassembled for assembly on site.

Figure 28A:
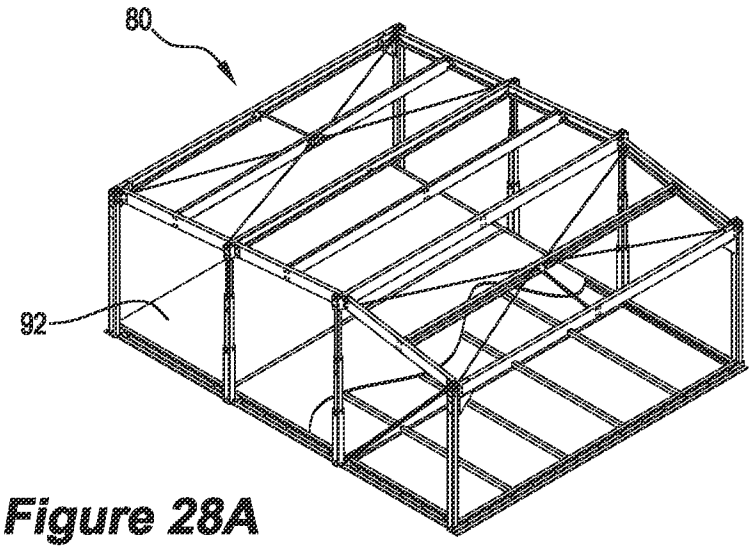
FIG. 28A illustrates a rammed earth foundation in the first ladder frames of the housing.
Figure 29B:
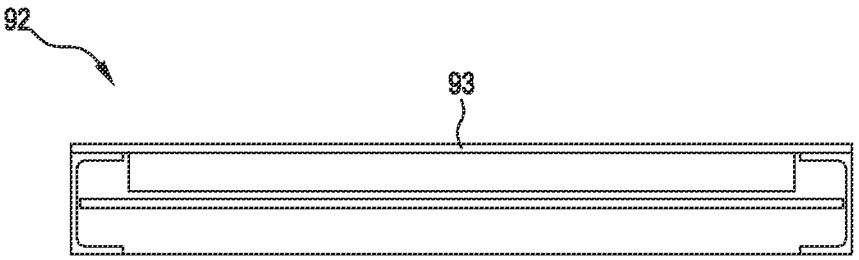
FIG. 29B illustrates a sectional view through the first ladder frame, illustrating a floor panel inserted between the rails of the ladder frame.
Figure 29C:
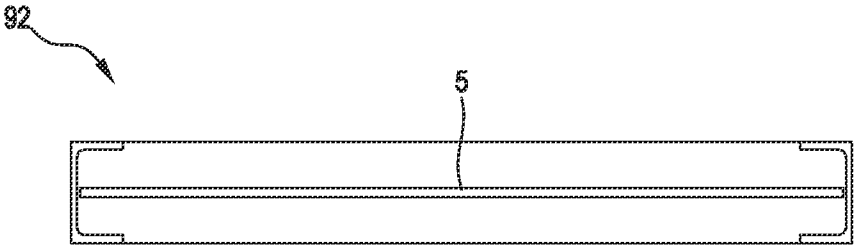
FIG. 29C illustrates a sectional view through the first ladder frame, illustrating a packing material in the ladder frame, such as compacted or rammed earth.

The first ladder frames of the structure 100 can be packed with compacted earth or rammed earth in some embodiments, to provide a base for the structure 100 (illustrated in FIG. 28A and FIG. 29C).

In some embodiments of the first ladder frame 12 the mesh 18 is welded or bolted directly into the beams 13 of the frame 12 without a separate outer frame 19 (see FIG. 25A-25H). The mesh 18 is entirely covered by a concrete mixture introduced into the frame 12. The mesh 18 can also be secured to the brace beams 5 across the frame 12.

Figure 29A:
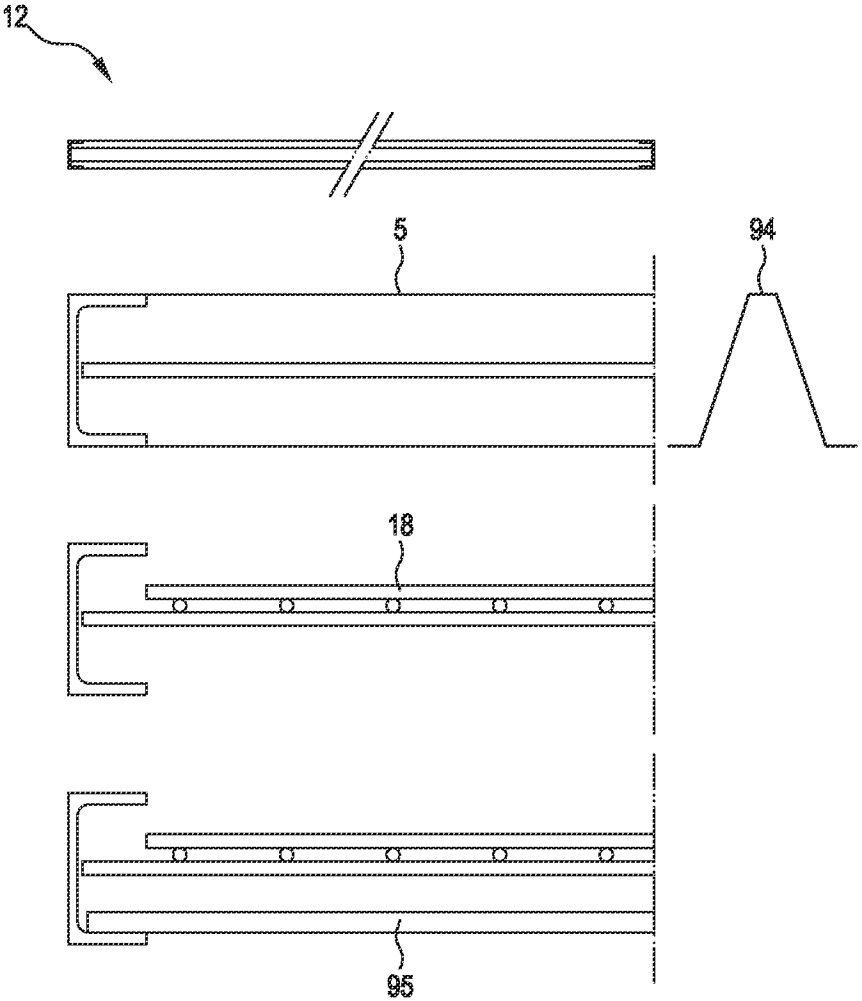
FIG. 29A is a sectional view through the first ladder frame, illustrating the brace beams through a centre line of the frame, a mesh supported on the brace beam, and a tray for suspended concrete.

In some embodiments where a suspended floor is to be used for example timber or boards 93, a series of top hat 94 or box sections can be inserted into the frame 12 to support the timber boards 93 and to set a level for the timber to be laid upon (see FIG. 29A-29C). A reinforcing mesh 18 can be supported on the top hat 94 or box sections, prior to receiving a concrete pour.

A tray 95 can be placed below the brace beams 5 in the frame 12 to provide a base for the frame 12 to constrain liquid concrete introduced into the ladder frame 12. The tray 95 can be supported by the open section of the beams 13 that form the frame 12 (see FIG. 29A).

The beams 13 are provided with a plurality of apertures, or locking bolt holes 87, for securing fixtures to the frame 12, or for securing a subsequent frame 12' to a first frame 12. The contemplated fixtures include, but are not limited to, brick angles, wall fitments, fly-screens, lifting brackets, paneling, fork lift pockets, etc.

The Columns 50

Figure 8:
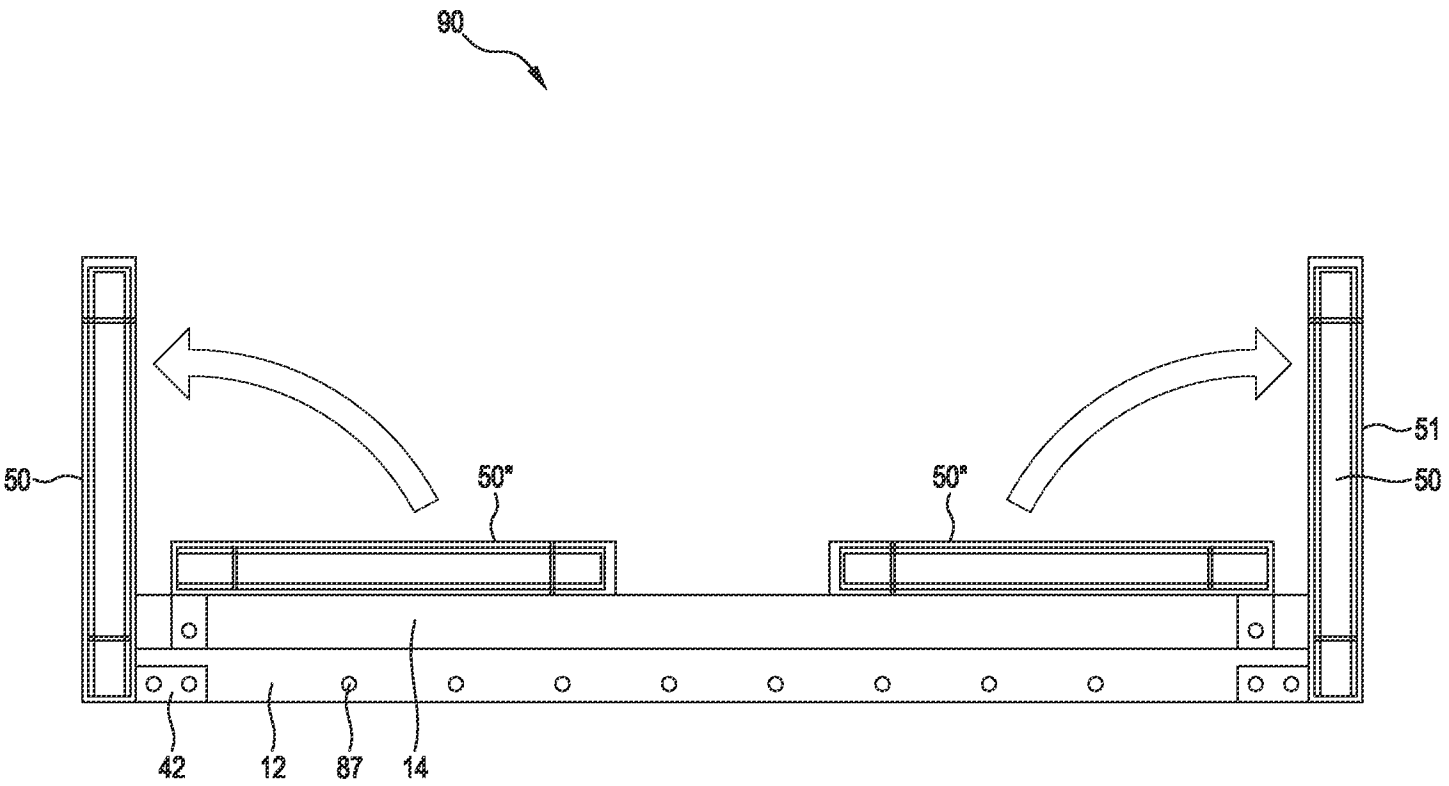
FIG. 8 is a side view of a chassis, illustrating a hingable connection between a pair of extendable columns and a base frame of the chassis.

A lower, or first column portion 51 is intended to act as a structural member providing a solid connection between the first ladder frame 12 and the extendable column 50 (see FIG. 8).

The columns 50 can be packaged loose within the kit 90 and installed on site. The columns 50 can be lifted with a jack or a machine on site. In some embodiments, selected columns 50 can be removed after the structure 100 is complete, to provide open areas within the structure 100.

The columns adjoining the first 12 and second ladder frames 14 can be a non-extendable column 57 or an extendable column 50. Furthermore, either of the columns 50, 57 can be constructed from hollow sections to allow the column 50, 57 to be filled with concrete for additional structural support, once erected and attached to the finished structure 100. Further embodiments of the columns 50, 57 will be described herein in reference to FIGS. 18-23.

The Top—Second Ladder Frame 14

The second ladder frame 14 is designed to provide stiffness to the structure 100 once constructed and during transportation as a kit 90.

The second ladder frames 14 are designed to be light weight so they can be lifted and installed with man power.

The second ladder frames 14 are not designed to provide equivalent structural strength to that of the first frames 12. The second frames 14 are intended to engage with a supporting beam and cross-beams 38 in the form of C-channels, to be installed onto the second ladder frames 14 to provide the necessary support for roof members 60 and roof panels 61 (see FIG. 15).

The second ladder frame 14 is designed to provide easy installation and support of the internal chassis 10.

Incorporating fork lift pockets 3 under the first ladder frame 12 and not through the ladder frame 12 provides the advantage of not weakening the frames 12 with pockets and allows the material gauge to be about 100 mm. This is illustrated in FIG. 9.

Figure 9:
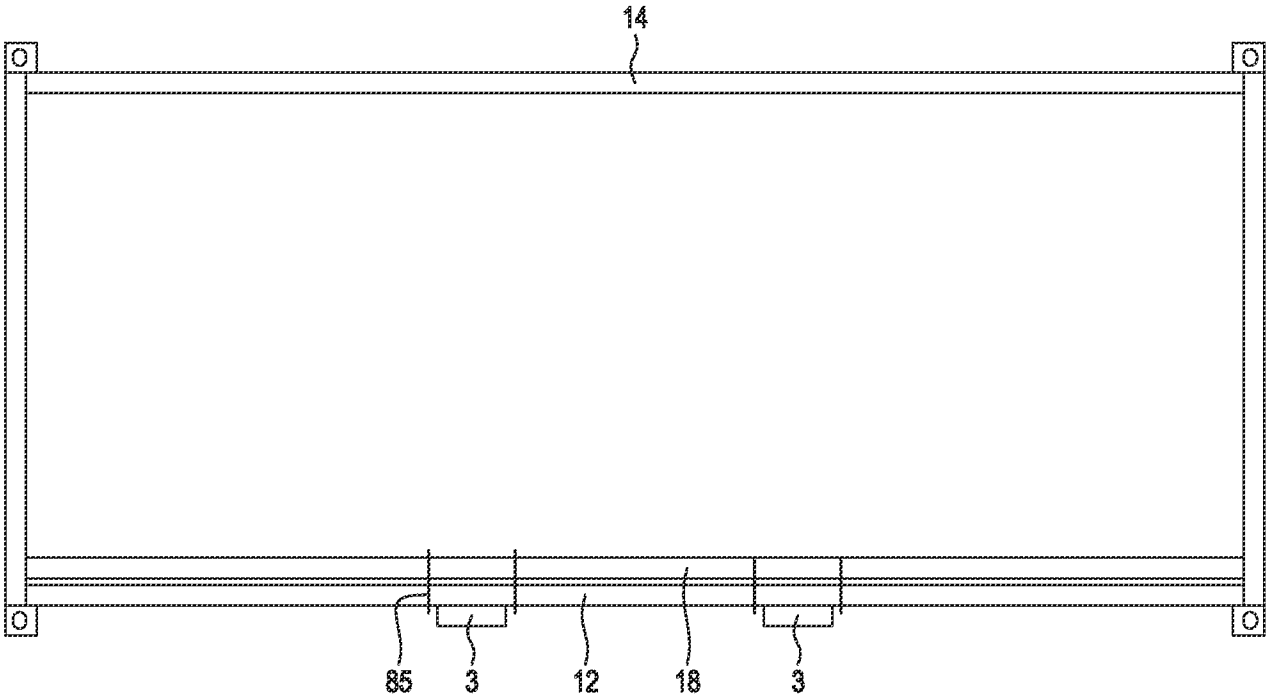
FIG. 9 is a side view of the chassis, illustrating a location for a pair of forklift pockets facilitating movement of the erected chassis.

Also shown in FIG. 9 are a series of transport bolts 85 inserted through the frames 12 and 18 to hold the frames together during transportation.

The second ladder frame 14 is designed to be light-weight and the strength of each can be increased for spans by adding C-purlins 15 into the frame 14 as a roof frame support (100×50 mm box section is envisaged).

Once the second ladder frame 14 is lifted to the predetermined height the column cover (not illustrated) will be affixed to hide the column 50 and provide structural support to the finished structure 100.

The designs within this document are created around the maximum length that can be transported within an ISO shipping container and use 20015C-section for calculations, however, it is contemplated that sizes would vary from build to build. There is a possibility of standardising the sizes and varying the thickness to accommodate different applications, thereby reducing the part variations required.

It is possible to provide sizing of C-channels 13 for roof and floor joists that can accommodate maximum spans. For example, 150C15 for up to 2.4 metre spans, 200C15 up to 4 metres, 6 metres etc. and once determined buildings can be designed in engineered segments.

The roof panels 61 can be configured as sandwich roof panels that will fit across the top frame 14. These panels are light and can be installed quickly.

A gable beam 25 will need to be specifically fabricated so that interconnecting components can be attached thereto.

Rafter battens (not illustrated) can be supported from the gable beam 25. In some embodiments the gable beams 25 are double sided to support rafter battens on either side thereof.

The End Frame 20

Figure 6B:
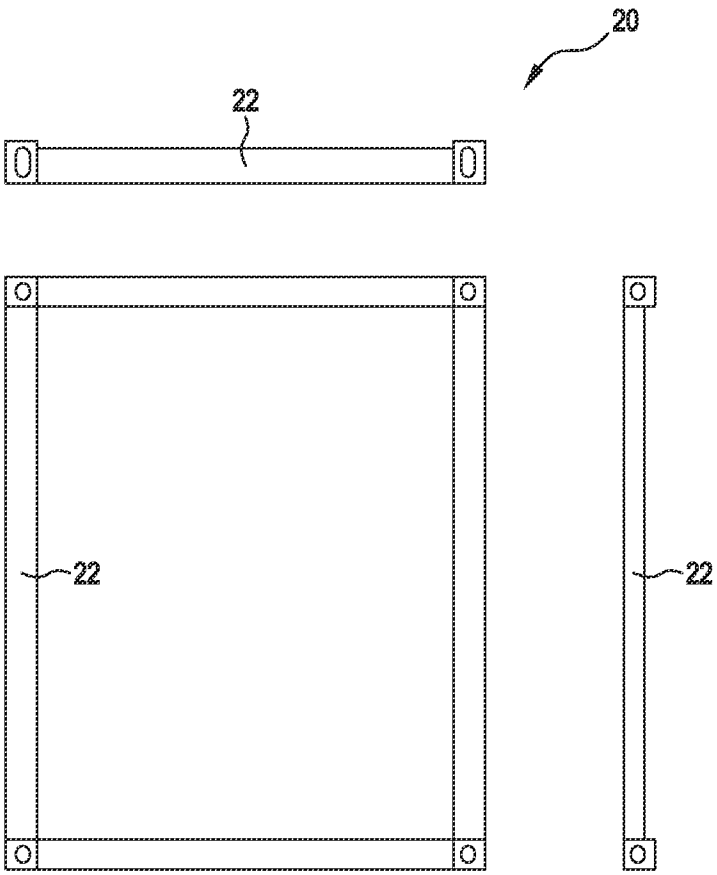
FIG. 6B is a third angle elevation of the end frame of FIG. 6A, illustrating a front view, side view and top view thereof.
Figure 6A:
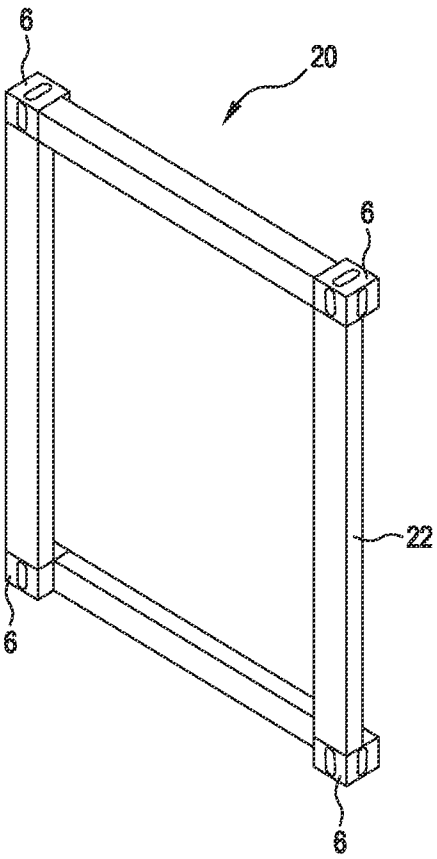
FIG. 6A is a perspective view of an end frame, configured to be used in pairs to constrain the members of the kit for long distance transportation.

FIG. 6A is a perspective view of an end frame 20, configured to be used in pairs to constrain the members of the kit 90 for long distance transportation.

FIG. 6B is a third angle elevation of the end frame 20 of FIG. 6A, illustrating a front view, side view and top view thereof.

When no longer required for transportation or packaging, the end frame 20 can be used alone, or in connection with columns 50, to provide additional structural components for the completed structure 100.

Figure 7D:
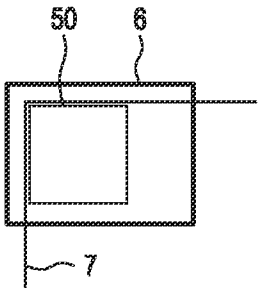
FIG. 7D is a cross sectional view through the ISO block of FIG. 7C illustrating a welded connection between the ISO block, the extendable column and the panels to be packaged therein.
Figure 7C:
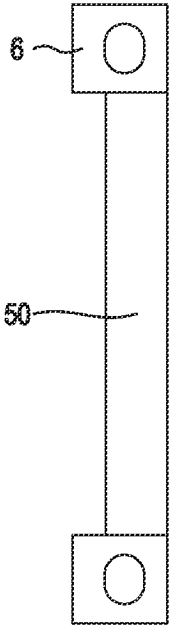
FIG. 7C is a side view of an extendable column of the chassis having an ISO block welded thereto.

Having standard ladder frames 12, 14 sized to fit inside an end frame 20 that when combined is suitable to transport within the form of an ISO shipping container format. FIG. 7A is a side view of an upright member beam 22 of the end frame 20 having an ISO block 6 welded thereto to form a part of the end frame.

Figure 7B:
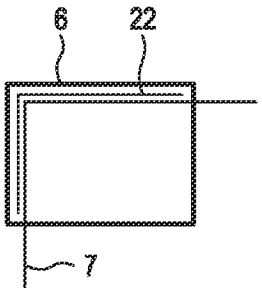
FIG. 7B is a cross sectional view through the ISO block of FIG. 7A illustrating a welded connection between the ISO block, the end frame and the panels to be packaged therein.
Figure 7A:
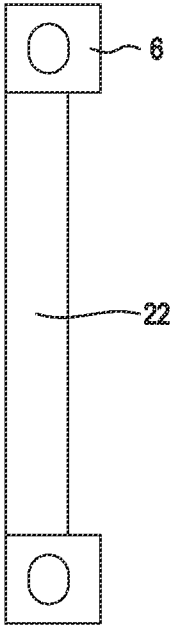
FIG. 7A is a side view of an upright member of the end frame having an ISO block welded thereto to form a part of the end frame.

FIG. 7B is a cross sectional view through the ISO block 6 of FIG. 7A illustrating a weld line 7 connecting the ISO block 6 to beam 22 of the end frame 20 to support packaged panels therein.

An L-shaped cross-section to beam 22 can capture the construction panels (ladder frames 12, 14, roof members 60, peripheral frame 40 etc.) and hold them in position. The end frames 20 can be removed and repurposed when the kit 90 arrives at its end destination. The end frames 20 can also be manufactured having telescopic beams 22 that expand and can be incorporated into the house 100 as a structural component for a range of functions, for example, as:

water tank frames
bracing units
door frames
floor and roof supports.

In some embodiments, the kit 90 can be formed by welding or otherwise affixing the extendable columns 50 of the chassis directly to ISO blocks 6 to allow construction panels (ladder frames 12, 14, roof members 60, peripheral frame 40 etc.) and exterior non-structural panels to be packaged therein, as illustrated in FIGS. 7C and 7D.

Using the apertures with the ladder frames 12, 14 it is also contemplated that packs of ladder frames can be bolted together using flat plates or angle brackets, without the need for ISO blocks for regional transportation.

Hinged Columns

In some embodiments, the extendable columns 50 are pivotally coupled to the first ladder frame 12 via a hinge 42, to allow the column to rotate between a transport position parallel to the first ladder frame 12 and an operative configuration where the column 50 is substantially perpendicular to the first ladder frame 12. From the transport position (illustrated as columns 50"), the columns 50 can be rotated or cranked-up into position (illustrated by arrows), ready to receive the second ladder frame 14 to be to the top of each column 50, illustrated in FIG. 8.

Transportation of as many components at the same time with quick assembly and low skills is a focus.

The first and second ladder frames 12, 14 are the same size (at least in area, if not in depth) and the four columns 50 are fixed to each corner of the first ladder frame 12. In this manner, the folded columns 50 can be nested within the internal chassis 10 during transport of the kit 90.

The columns 50 can be packed separately, or pre-connected with the hinge 42 to the roof frame to get cranked up to standing height when in place. The pair of end frames 20 each comprise four beams 22 and four corner members illustrated in FIG. 6A as ISO blocks 6. The beams 22 and ISO blocks 6 can be welded or bolted together or a combination of welding and bolts.

Peripheral Frame 40 and External or Exterior Chassis 30 (Single Storey)

Figure 11B:
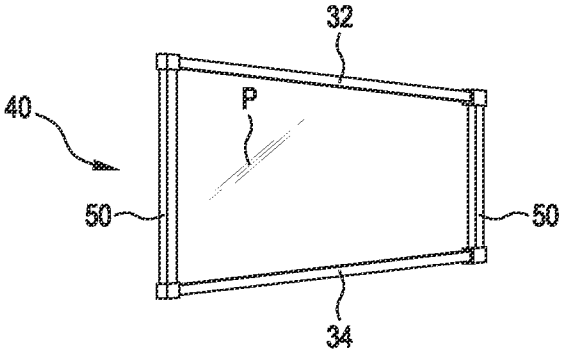
FIG. 11B is a perspective view of a single height expandable perimeter frame, that partly forms an external chassis for increasing the usable footprint and volume of the structure.

The peripheral frame 40 is formed from a lower member 34 and an upper member 32 which are joined at opposing ends to a pair of extendable columns 50. The peripheral frame 40 can be combined with cross-beams 38 to provide an external chassis 30. The external chassis 30 is supported by at least one internal chassis 10 and can be used to join a pair of internal chassis 10 to provide an increased footprint to the structure 100. An embodiment of the peripheral frame 40 is illustrated in FIG. 11B.

In some embodiments the peripheral frame 40 can also be used to replace roof members 60.

Double Storey Chassis 11

Figure 10:
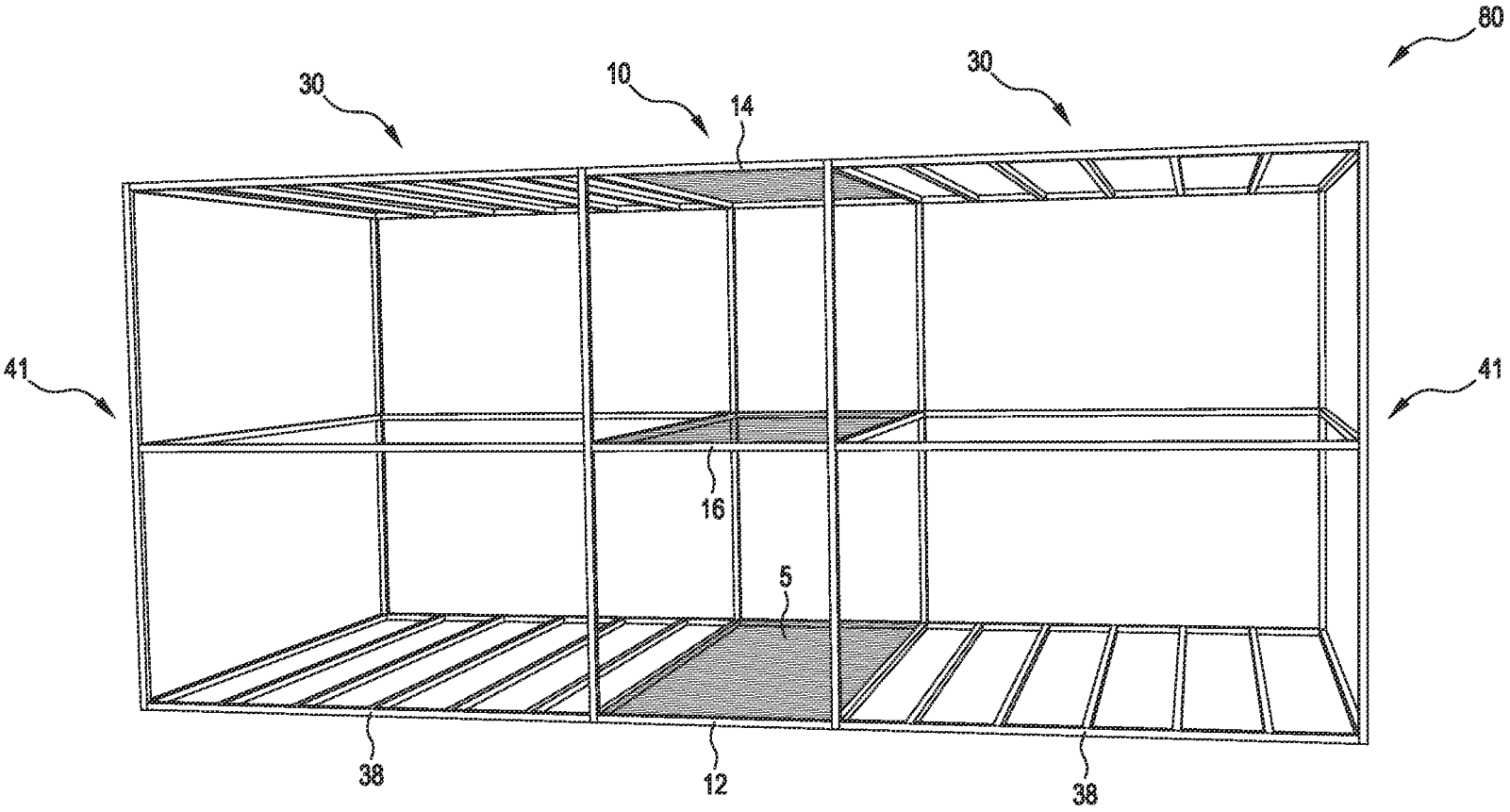
FIG. 10 is a double storey structure according to one embodiment of the invention using a single, double storey chassis.

In some embodiments the invention provides a double storey structure which is constructed using a double storey extendable internal chassis 11. As illustrated in FIG. 10. The double storey internal chassis 11 comprises a first ladder frame 12, a second ladder frame 14 and an intermediary ladder frame 16 which is disposed between the first and second ladder frames. The three ladder frames are engaged to one another via eight extendable columns 50, each column 50 being engaged at a corner of the intermediary ladder frame 16. Alternatively, the three ladder frames 12, 14, 16 can be engaged to one another via non-extending columns 57.

Expandable Peripheral Frame 41 (Double Storey)

The peripheral frame 40 can be formed as an expandable peripheral frame 41 to accommodate the double storey chassis 11. The expandable frame 41 is formed from a lower member 34 an upper member 32 and an intermediary member 36. The intermediary member 36 is attached to each of the upper and lower members via a pair of extendable columns 50 (see FIGS. 10 and 11A-C). The peripheral frame 41 can be combined with cross-beams 38 to provide an external chassis 30. The external chassis 30 is connected to the internal chassis 11 at three different levels, a first level an intermediary level and a second level. In this manner the intermediary ladder frame provides a second level floor to the structure and the second ladder frame 14 defines a top of the structure 100 prior to the attachment of roof members 60 or roof panels 61.

Figure 11C:
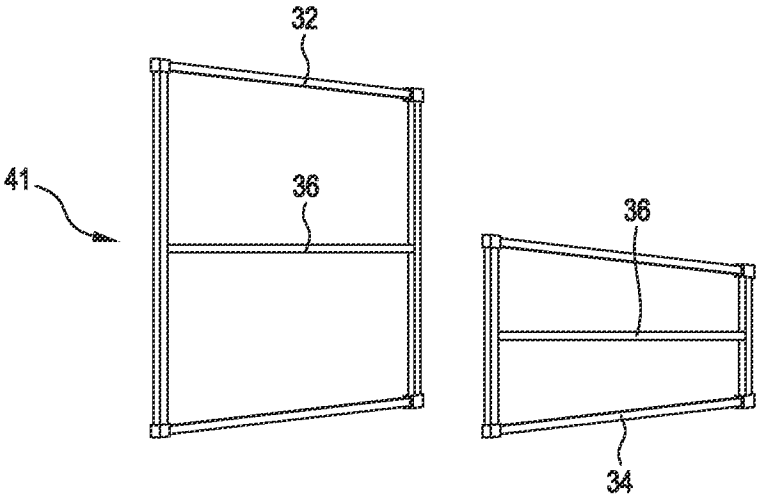
FIG. 11C is a perspective view of a double height expandable perimeter frame, that partly forms an external chassis for increasing the usable footprint and volume of the structure.
Figure 11A:
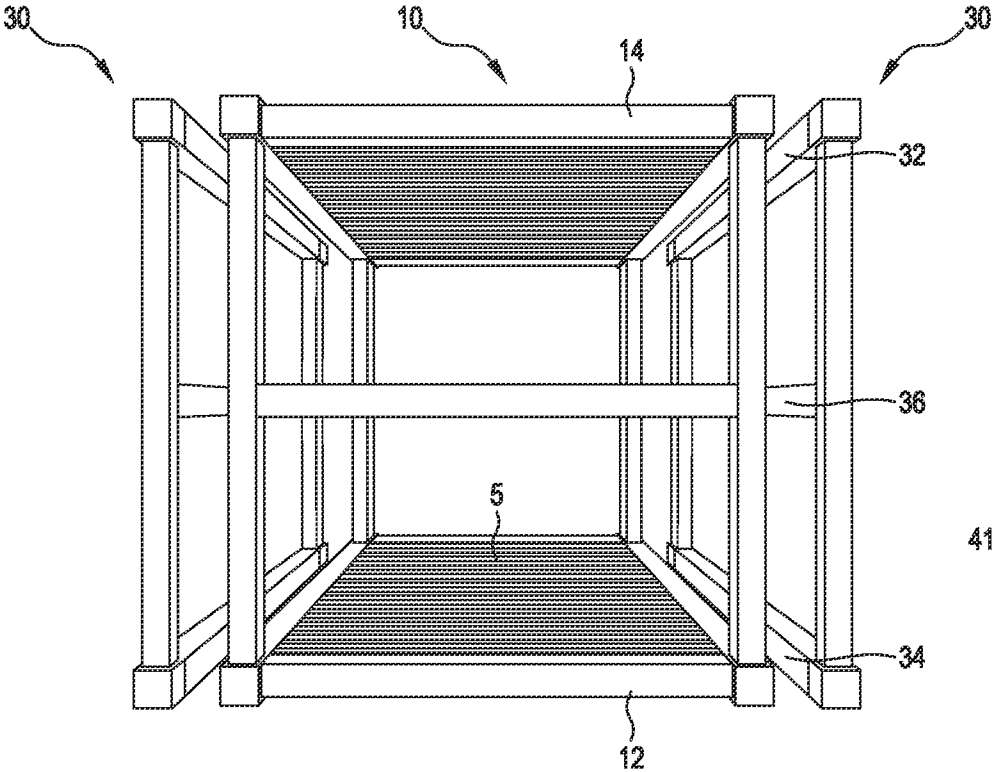
FIG. 11A is the double storey chassis of FIG. 10, in a transportable configuration, prior to construction of the structure.

The external chassis 30 is supported by at least one internal chassis 11 and can be used to join a pair of double storey internal chassis 11 to provide an increased footprint to the structure 100. An embodiment of the peripheral frame 41 is illustrated in FIG. 11C.

In some embodiments the peripheral frame 41 can also be used to form a roof frame 60.

FIGS. 12 and 13 illustrate alternative embodiments of double storey structures 100 constructed from a plurality of kits 90.

Figure 12B:
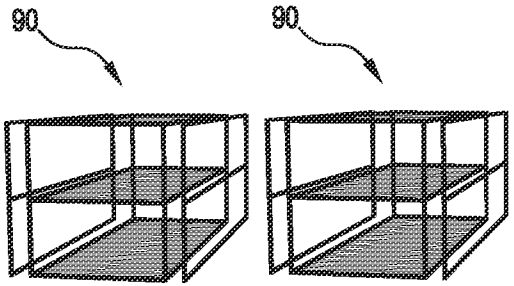
FIG. 12B is a perspective view of a kit for constructing the structure of FIG. 12A.
Figure 12A:
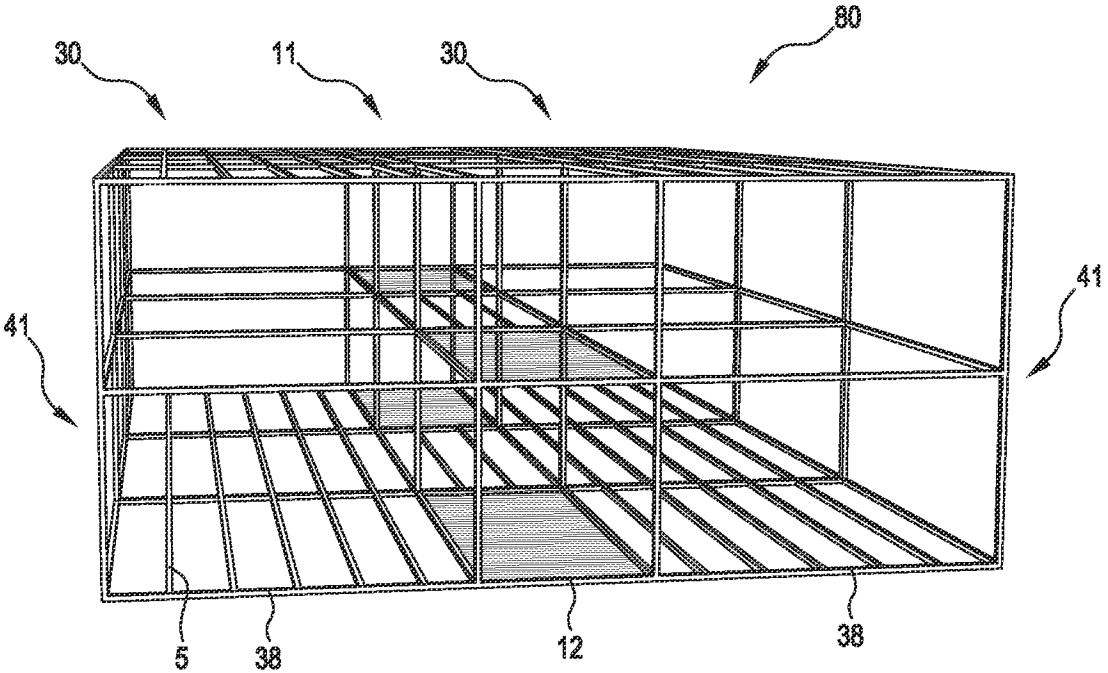
FIG. 12A is a double storey structure according to one embodiment of the invention using two double storey chassis.
Figure 12D:
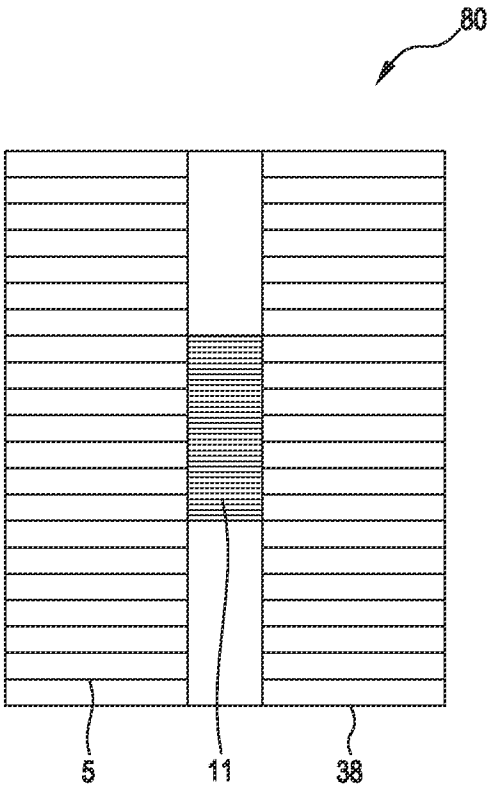
FIG. 12D is a plan view of the structure of FIG. 12C, illustrating the location of the central core among the external chassis.
Figure 12C:
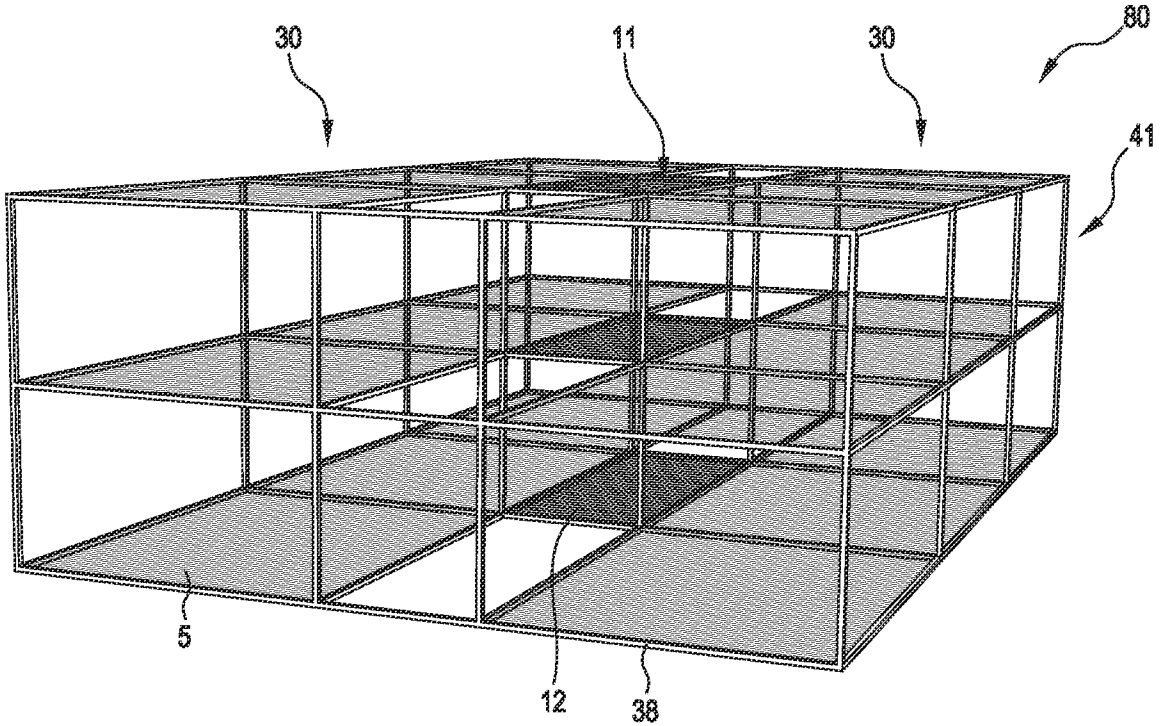
FIG. 12C is a perspective view of a double storey structure, using a singe double storey internal chassis and a plurality of external chassis surrounding the central core.

FIGS. 12C and 12D illustrate a double storey structure 100 according to one embodiment having a single double storey internal chassis 11, that supports six external chassis 30 thereabout. In this embodiment the structure provides 14.4 m×18 m of floor area from a single internal chassis 11.

Figure 13B:
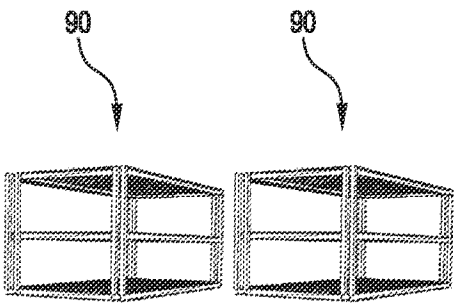
FIG. 13B is a perspective view of a kit for constructing the structure of FIG. 13A.
Figure 13A:
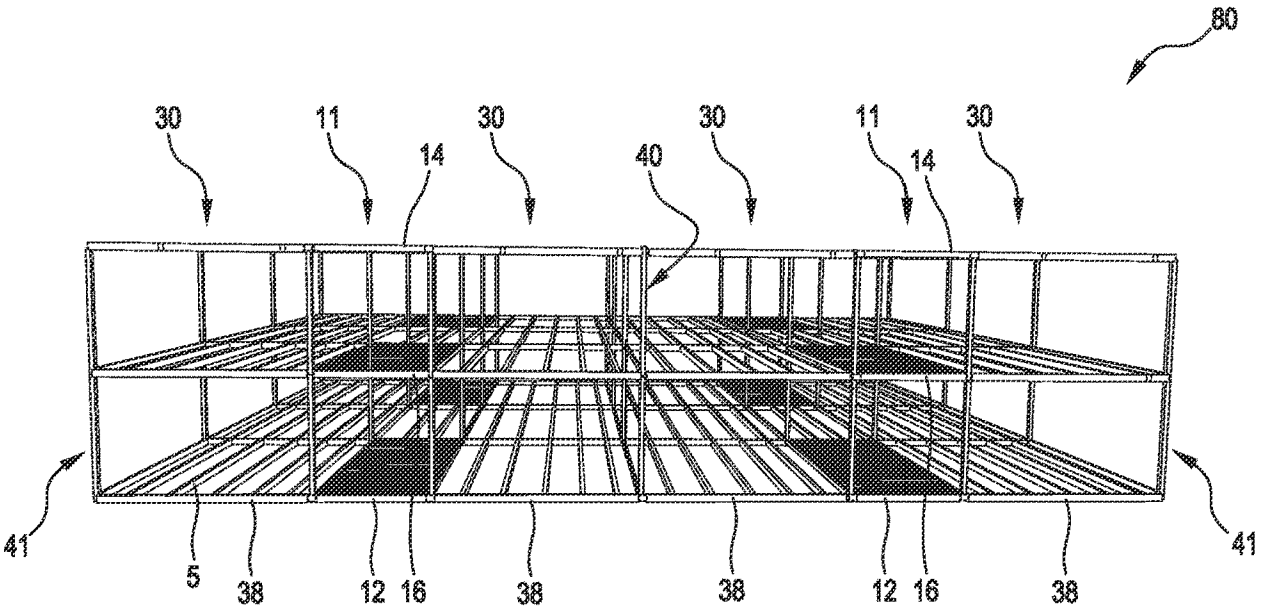
FIG. 13A is a double storey structure according to one embodiment of the invention using a plurality of double storey chassis.
Figure 14:
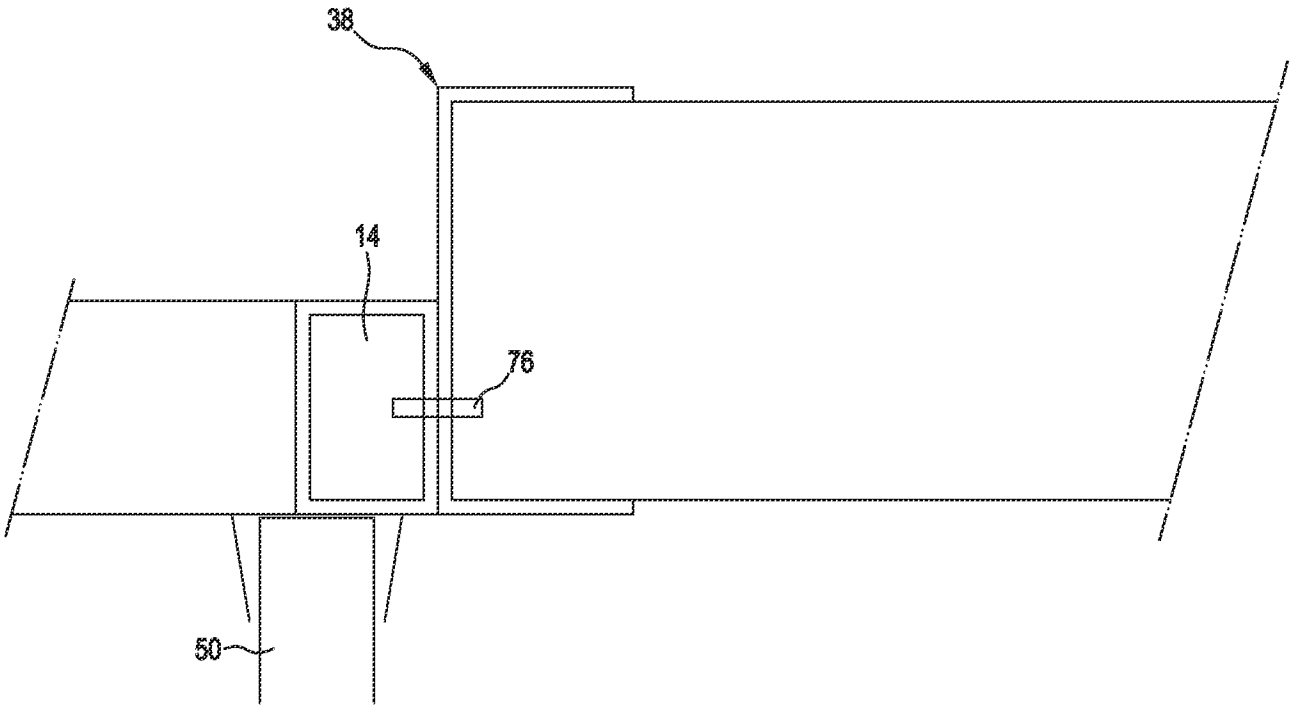
FIG. 14 is a cross sectional view of a joint between an upper frame of the internal chassis and a C-channeled cross-member forming a portion of the external chassis that is supported from the internal chassis.

FIGS. 13A and 13B illustrate a double storey structure 100 according to one embodiment having four double storey internal chassis 11, that support twelve external chassis 30 thereabout. The internal chassis 11 are set along the periphery of the structure, as opposed to centrally, as shown in FIGS. 12C and 12D. In this embodiment the structure provides 28.8×18 m of floor area from four internal chassis 11.

Cross-Beams 38

The system is designed to have interchangeable standard parts. For example, where;

- Purlins 15 and rafter battens will have design allowance for use in various locations along the internal 10 and external chassis 30 and the cross-beams 38 connecting therebetween.
- Holes can be pre-punched in all components to allow fixings in multiple locations and applications, to be used for various functions (Floor joists and roof rafters and battens.
- The overall design, sizes and configurations are defined by standard sizes to ensure material availability regionally.
- Container Frame PFC channels are folded to be sized to have standard rolled sections which fit inside such as floor joists or roof rafters.
- Location fixing holes in each component to allow as example 450 mm hole centres match floor joist centres of 450 mm and a roof rafter spacing of 900 mm.

Configurations of the Finished Structures 100

Figure 16:
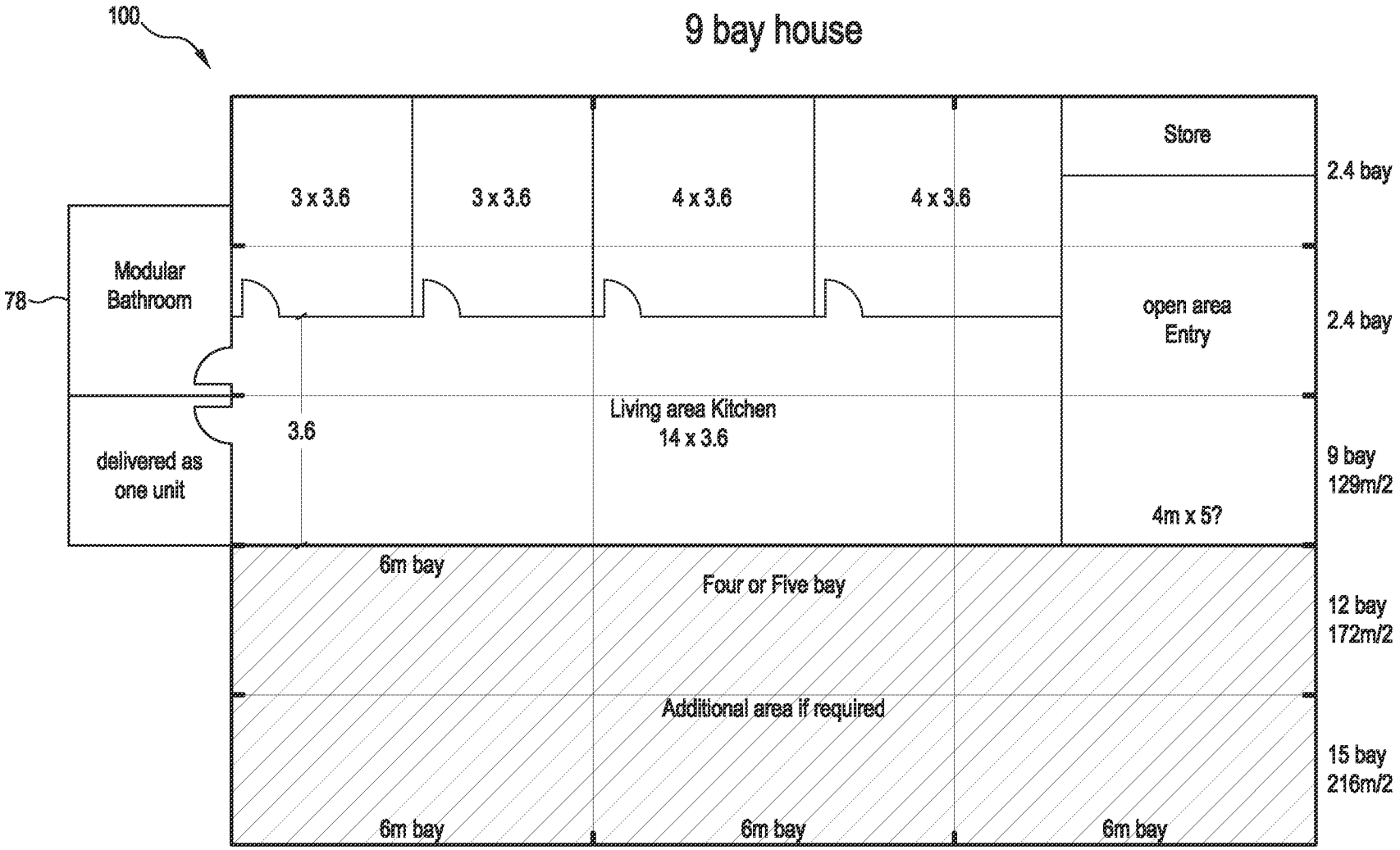
FIG. 16 is an exemplary layout of a 9-bay, 12-bay and 15-bay house constructed using the modular housing system according to one embodiment of the invention where each bay is approximately 6 m×2.4 m.

FIG. 16 is a layout of a 9-bay, 12-bay and 15-bay house constructed using the modular housing system according to one embodiment of the invention where each bay is approximately 6 m×2.4 m:

In using this modular housing system, a myriad of standard design formats can be constructed.

Figure 15:
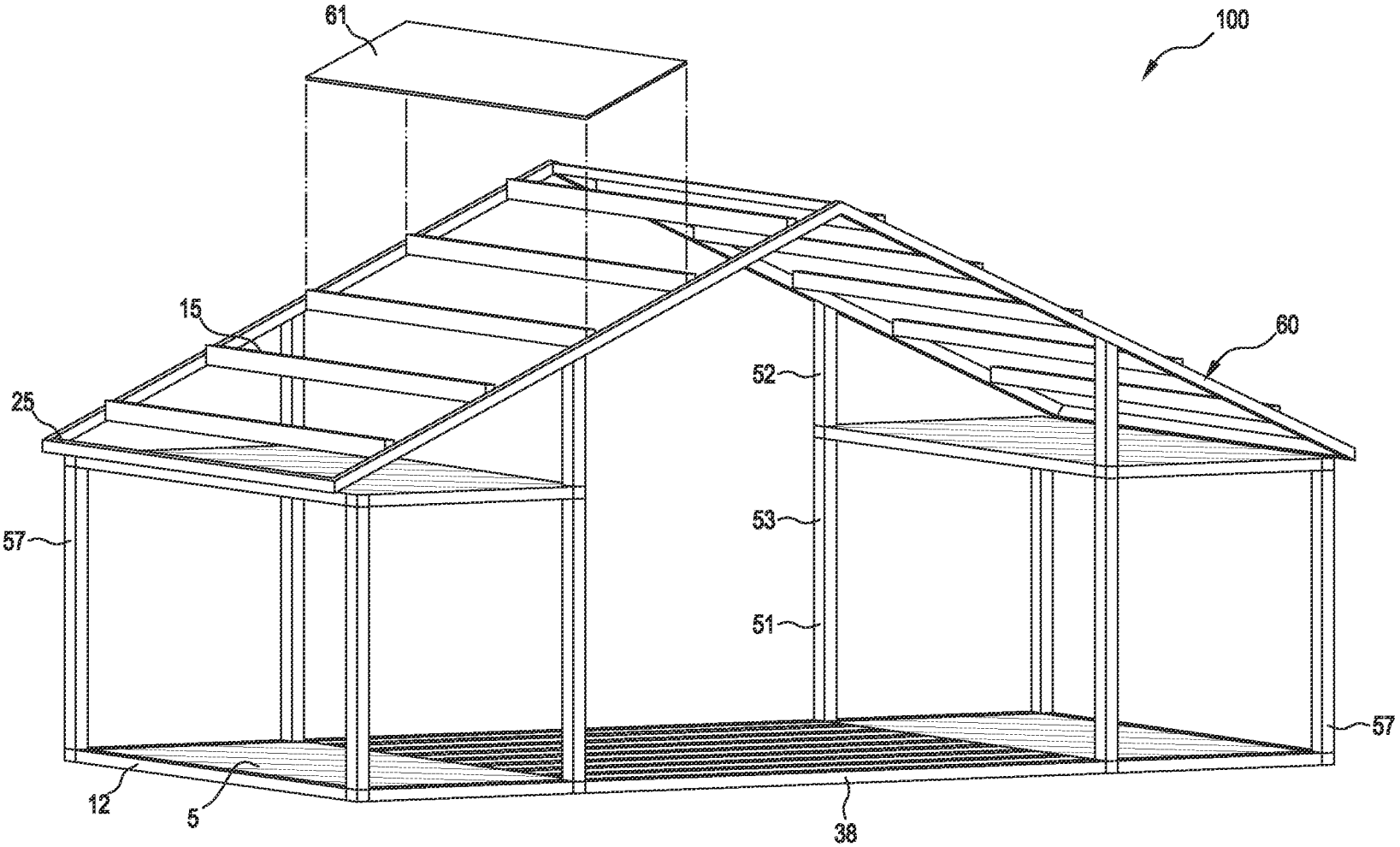
FIG. 15 is a quick-deploy structure according to one embodiment of the invention, illustrating extendable columns for fixing and support a plurality of roof beam and roof panels to facilitate deployment of the structure.

Four examples of design formats are illustrated in FIGS. 15 and 16.

1. The 3-bay panel house is designed to be quickly deployed and installed with the ability to resist category 5 cyclones (see FIG. 16).
2. The 5-bay panel offering an increase in floor area over the 3-bay format.
3. The 9-bay community centre that can also be used for storage or for a hospital if required.
4. The 12-bay and 15-bay community centre that can also be used for storage or for a hospital if required.

FIG. 16 illustrates possible floor plans and variations on a housing layout, superimposed with individual bays for reference. Additional modules are illustrated adjoining the main structure 100 to provide modular bathroom unit 78.

The illustration of FIG. 16 illustrates a peripheral frame 40 at each end of the structure with an infill between.

The required room and wall layout can be upsized by using the grid to increase the number of available bays.

High Rise System

In one aspect, a modular housing system, comprises a structural framework 80 and exterior walls and a roof supported by the framework 80, the framework 80 comprising an internal chassis 11 as a core structural element, the internal chassis 11 including;

- a first ladder frame 12 defining a base;
- four extendable columns 50 engaged to the first ladder frame;
- a second ladder frame 14 engaged to the first ladder frame via the four extendable columns 50; and
- an intermediary ladder frame 16, engaged with each of the four extendable columns 50 and disposed substantially half way between the first ladder frame 12 and the second ladder frame 14, such that a first distance between the first ladder frame 12 and the intermediary ladder frame 16 is adjustable, and a second distance between the intermediary ladder frame 16 and the second ladder frame 14 is adjustable.

Figure 17A:
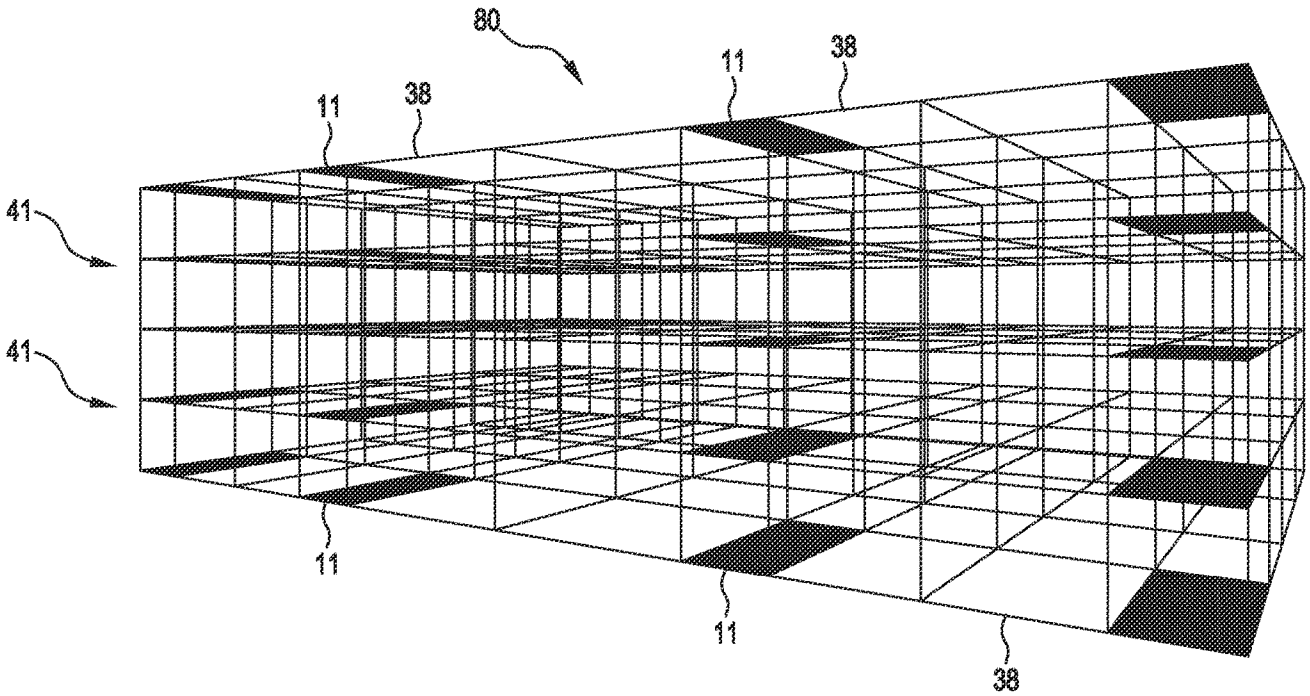
FIG. 17A is perspective view of a multi-storey structure constructed from the modular housing system according to one embodiment of the invention.
Figure 17B:
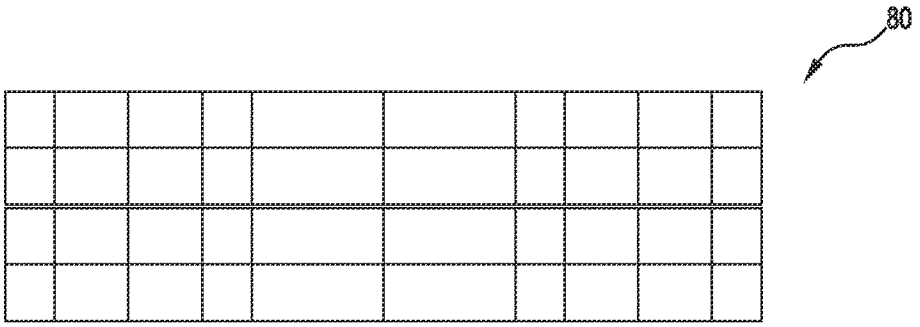
FIG. 17B is a front elevation of the structure of FIG. 17A, illustrating 16 double storey chassis, supporting a plurality of cross beams and intervening perimeter frames.

An embodiment of the modular housing system used to construct a multi storey building is provided in FIG. 17A (in a perspective view) and FIG. 17B (in a front elevation).

The high rise structure 100 is underpinned by the structural framework 80 which comprises a plurality of double storey chassis 11 interconnected with a plurality of expandable end frames 41 and a plurality of cross-beams 38, subsequently topped with an additional level comprising a plurality of double storey chassis 11 interconnected with a plurality of expandable end frames 41 and a plurality of cross-beams 38.

System for Collapsible 2-Story Units

The double height design was developed when using the system in 2-3 storey residential structures 100. When double height, the 2-storey nature does not require two roofs and floors, so a 3 panel, 2-story frame was developed. Double height designs will be commonly applied to residential builds with future design looking to enhance the system for commercial applications.

With the use of one double storey chassis 11, with two side frames 41 and standard floor reinforcement mesh 18, an achievable format of the structure 100 becomes 176 $m^2$. Using 2 double storey chassis 11 and four peripheral frames 41 an achievable format of the structure 100 becomes 480 $m^2$.

Exploring double height/storey designs with the use of end frames and interim supports and cross beams 38 will expand the portfolio of available structures 100 where the system can be applied with double height container Connecting internal chassis to external chassis It is contemplated that a plurality of apertures can be cut, punched or otherwise formed in almost any of the components of the modular housing system, for example the first or second ladder frames 12, 14, the extendable columns 50, the cross-beams 38, the roof members 60, the c-purlins 15, the peripheral frames 40, 41 etc. The apertures in the steel components can be half cut to fold into holes in other components to lock into position. Clipping systems could also be employed to engage and retain the components of the system together. It is also contemplated that some members of the system can provide recesses or protrusions with which to position or engage additional components of the housing system.

It is further contemplated that some components of the system can be manufactured to have self-securing features such as a spring-loaded bolt or catch design, to secure structural components without the need for bolts to be delivered on site.

Walling Systems

Attached to the structural framework 80 of the structure 100 are external wall panels (not illustrated). The external wall panels are attached to the structural framework 80 with various wall connection options designed into the internal chassis 10 and the external chassis 30. The connection options can comprise channels, slots, holes, protrusions, recesses, cut-outs and the like for securing fly-screens, security mesh, plywood, tarps, chipboard, fibreboard, paneling etc.

Users can enclose the structure 100 in a variety of different material that can then be reinforced with mud bricks or alternatively reinforced with more long-term materials around an outside of the structure 100 such as brick, Hebel blocks, timber or other forms of cladding.

Affixing Roofs or Sheeting

Emergency panels can be delivered with paneling and fixtures enclosed. This provides a drop-in solution for emergency use in disaster recovery situations or in emerging economies where resources are scarce.

Emerging economy systems can also adapt the housing system to accommodate for local materials such as straw roofs, corrugated iron, bamboo or whatever natural resources are available.

Tilting Roof Structure

In one aspect, a modular housing system comprises a structural framework 80 and exterior walls and a roof supported by the framework 80, the framework 80 comprising an internal chassis 10 as a core structural element, the internal chassis 10 including:

- a first ladder frame 12 that defines a base;
- two pairs of extendable columns 50; and
- a second ladder frame 14 engaged to the first ladder frame 12 via the two pairs of extendable columns,
- such that both a distance and an angle θ between the first ladder frame 12 and the second ladder frame 14 is adjustable.

When the parallel columns 50 are lifted, it is not possible to create a sloped top frame 14 without the columns 50 distorting and going off parallel because as the roof slope is formed a hypotenuse and longer angle length is required compared to the level horizontal plane. This would normally cause the columns 50 to lean in and bind. To allow this hypotenuse to be formed offset hinges are incorporated with a choice of pivot points to allow multi-function and multiple hypotenuses or roof angles.

Figure 20B:
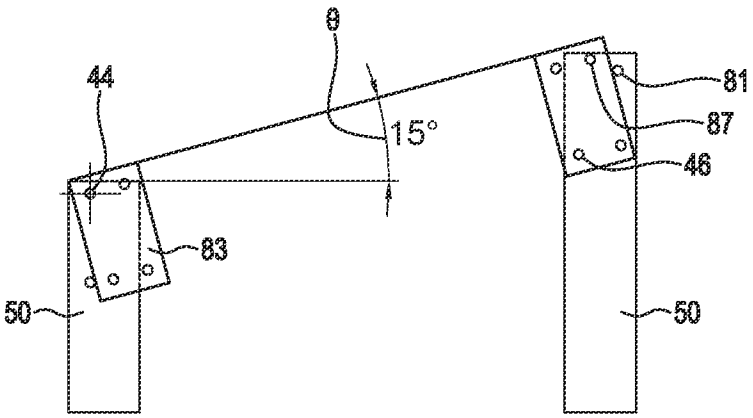
FIG. 20B is a schematic end view of the pair of extendable columns of FIG. 20A the upper frame rotated through angle θ as a first of the columns is extended farther that a second of the columns, illustrating a pitching of the upper ladder frame.
Figure 20C:
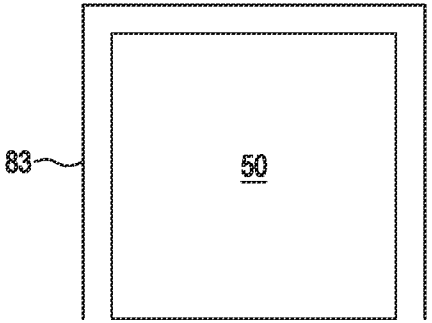
FIG. 20C is a sectional view of one embodiment of upper ladder frame having a section configured to conform partially about a column, thereby forming a C-channel hinge.
Figure 20A:
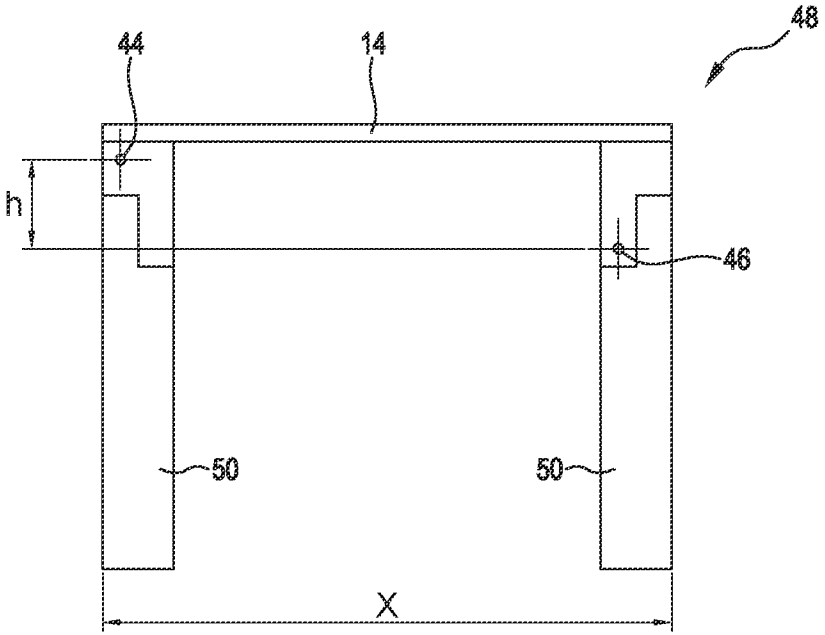
FIG. 20A is a schematic end view of a pair of extendable columns pivotally attached to an upper ladder frame of the chassis, illustrating a pair of offset pivot axes.
Figure 20E:
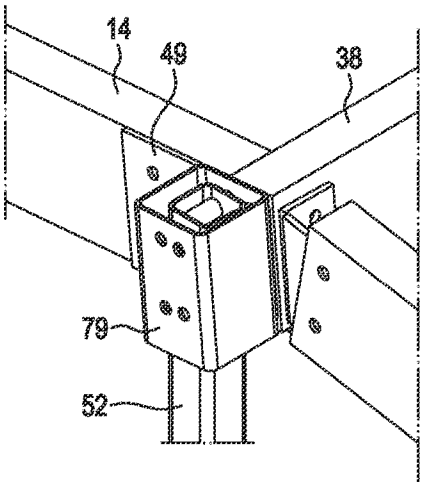
FIG. 20E is a perspective view of the hinged roof joint of FIG. 20D, illustrating the box section bracket for rotatably mounting the upper ladder frame to the column.

FIG. 20A is a schematic end view of a pair of extendable columns pivotally attached to an upper ladder frame of the chassis, illustrating a pair of offset pivot axes. The pair of offset axes comprise a first pivot 44 and a second pivot 46. Pivot 44 is higher than pivot 46 defining an offset height "h" therebetween. The columns 50 are spaced apart from each other over a distance "x". This then defines a maximum angle of inclination θ for the upper ladder frame 14, such that Sin θ=h/x FIG. 20B is a schematic end view of the extendable columns of FIG. 20A rotated through angle θ as a first of the columns 50 is extended farther that a second of the columns, illustrating a pitching of the upper ladder frame;

- The pivots 44, 46 form a hinge 48 between the columns 50 and the second ladder frame 14. The hinge 48 must nest into the column 50 during transport of the kit 90 and provide structural resistance.
- The hinge 48 is designed such that the pivot points 44, 46 can cater for differing angles θ.
- Fixing points are provided at an upper portion of the column 50 that allow bolts to lock structurally into position at different angles θ. The hinge 48 can then be set and fixed for transport using the transport bolt hole 81. Subsequently, the hinge 48 can be released to raise the structure 100 when required. The locking mechanism (illustrated in FIG. 20B) comprises a series of locking bolt holes 87 through the column 50 that can be aligned with components of the second ladder frame 14 or hinge 48 to receive a bolt or locking pin when aligned.
- A splice/rebate/key feature can be designed into each of the columns 50 to facilitate engagement with a lock mechanism for transport.

FIG. 20C is a sectional view of one embodiment of the upper ladder frame 14 having a section configured to conform partially about a column 50, thereby forming a C-channel hinge 83, allowing pivoting movement of the upper ladder frame 14 relative to the column 50.

Figure 20F:
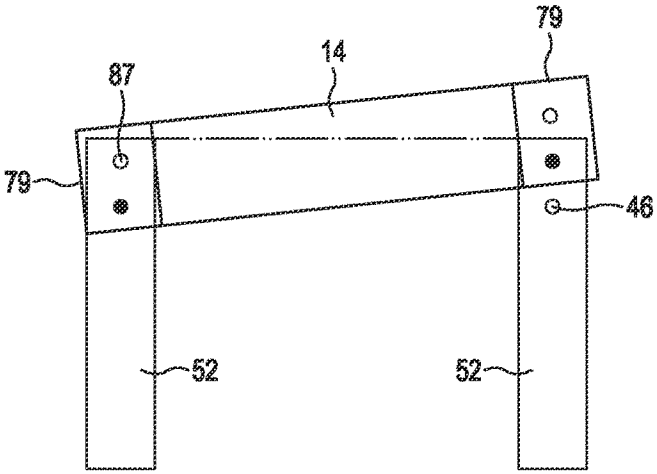
FIG. 20F is a schematic representation of a pair of oversized box section brackets used to attach the columns to the upper ladder frame to provide an angled roof joint.
Figure 20D:
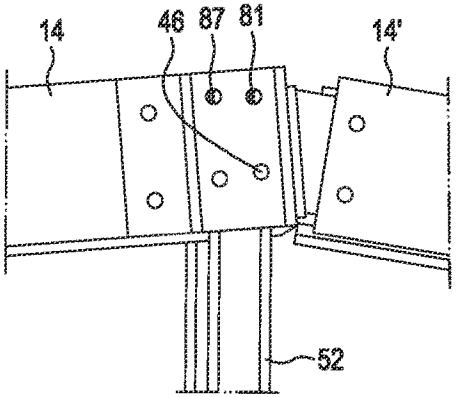
FIG. 20D is a perspective view of a hinged roof joint, providing an angled connection between adjacent second ladder frames forming the roof profile of the house.

FIG. 20D is a perspective view of a hinged roof joint, providing an angled connection about pivot 46 between adjacent second ladder frames 14, 14' forming the roof profile of the completed structure 100. The angled connection is configured with a box section bracket 79 that is mounted at the upper most end of the second column portion 52.

Locking bolt hole 87 is not used in the hinge 48, and the pivot point is created about bolt hole 46.

The box-section bracket 79 provides a plurality of mounting holes that can be used to pivot the connection between the bracket 79 and the column and also to lock (using bolts 85) the bracket 79 is the desired orientation relative to the column 50.

The box section bracket 79 is between 100-200 mm in depth, the locking bolt holes spaced about 100 mm apart. This allows the bracket 79 to be attached to the column via the first or second pair of holes 87. This provide an additional 100 mm of height between two adjacent columns to accommodate one column being extended to a greater height that the other. Alternatively, the upper columns 52 can be set to the same height, and the box section bracket 79 used to create a hinge for the upper ladder frame 14, as illustrated in FIG. 20F.

The box section bracket 79 is affixed to the upper ladder frame 14 using a plate bracket 49. The bracket 49 is also used to affix the first (lowest) portion 51 of the column 50 to the first ladder frame 12 (illustrated schematically in FIG. 21A). The brackets 49 and 79 may be welded or bolted to the column 50 or frames 12, 14.

Extendable Column

Figure 18B:
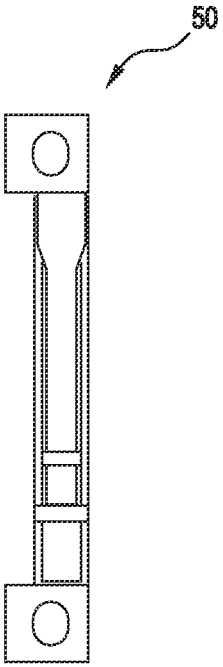
FIG. 18B is a sectional view of the extendable column FIG. 18A, illustrating the column in a fully retracted, transportable configuration.
Figure 18A:
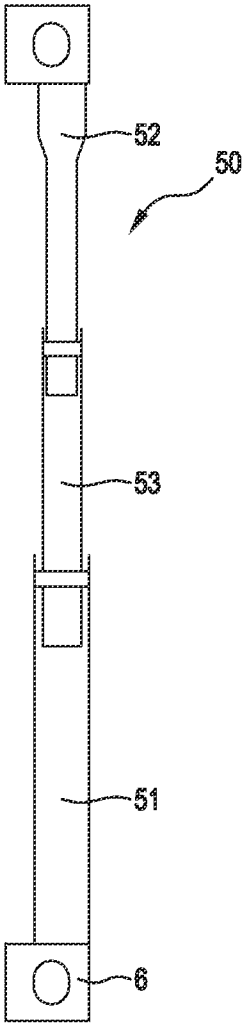
FIG. 18A is a sectional view of an extendable column according to one embodiment of the invention, illustrating the column in a full extended configuration.

FIG. 18A is a sectional view of an extendable column, illustrating the column in a full extended configuration. FIG. 18B is a sectional view of the extendable column of FIG. 18A, illustrating the column in a full retracted, transportable configuration. The column 50 comprises three components, a first portion 51, a second portion 52 and a third portion 53. The first portion 51 has the largest cross section to accommodate the second portion 52 and third portion 53 therein, in a retracted configuration. The column 50 is illustrated in FIGS. 18A and B having an ISO block 6 welded to opposing ends thereof.

Figure 19C:
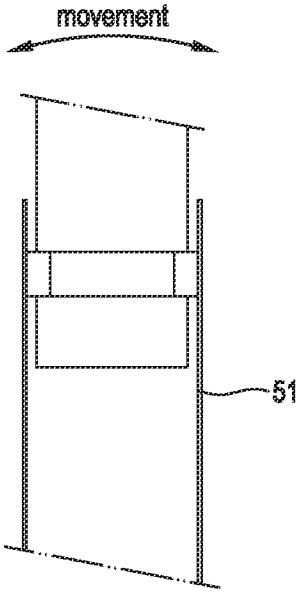
FIG. 19C is a schematic view through the extendable column, illustrating the guide member in place between an upper and lower portion of the extendable column.
Figure 19A:
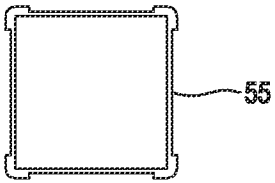
FIG. 19A is a top view of a guide member for use within the extendable column of FIG. 18A.
Figure 19B:
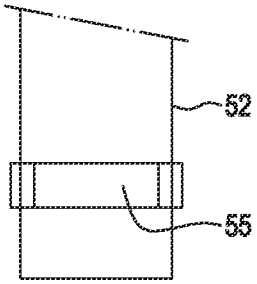
FIG. 19B is a cross section of the guide member of FIG. 19A in position within an extendable column, illustrating a thickened cross section in each corner.

A guide member, illustrated as a Nylon slide 55 is illustrated in FIGS. 19A-C. A first slide 55 is located between the first portion 51 and the second portion 52 and a second slide 55 is positioned between the second portion 52 and the third portion 53. The slide 55 assists in guiding the relative movement between the portions of the column 50. The slide 55 also cushions the connections therebetween. The slide 55 can be provided with thickened corner portions that may assist in reducing the opportunity for overturning of the portions of the column 50 when at their fullest extension, see FIG. 19C.

FIG. 20 illustrates internal portions of the extendable column in a transportable, partially extended and fully extended view, wherein the third or central member 53 of the column 50 provides a drive mechanism 56 for extending the column 50 in situ.

Each of the first 51 and second portions 52 are separable into a lower 51*a*, 52*a* and an upper portion 51*b*, 52*b*.

When the column is fully retracted the lower portion 51*a* and upper portion 51*b* of the first portion 51 are brought into contact to fully enclose the second 52 and third portions 53 within the first portion 51.

When the column is fully retracted the lower portion 52*a* and upper portion 52*b* of the second portion 52 are brought into contact to fully enclose the third portion 53 within the second portion 52, within the first portion 51.

Self-Jacking Column

In one aspect there is provided an extendable column 50, comprising:

a first hollow member 51 and a second hollow member 52, wherein the second hollow member 52 is dimensioned to sit within the first hollow member 51 providing the column 50 with a retracted mode in which the second hollow member 52 is substantially disposed within the first hollow member 51, and an extended mode in which the second hollow member 52 substantially extends outwardly from the first hollow member 51; and a driver 53 for driving movement of the second member 52 relative to the first hollow member 51, wherein in the retracted mode the actuator is packaged substantially within the second hollow member, within the first hollow member.

Figure 22C:
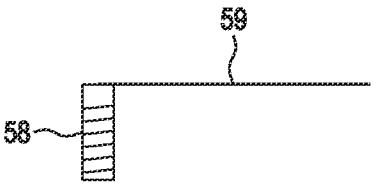
FIGS. 22C-22E each illustrate the drive mechanism in engagement with a handle for actuating the mechanism in different embodiments of the invention, respectively a worm gear arrangement, a ratchet arrangement and an epicyclic gear arrangement.
Figure 22D:
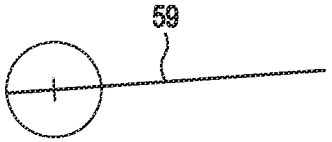
Figure 22E:
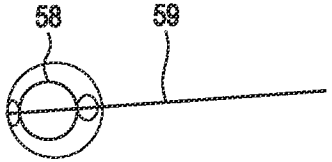
Figure 22B:
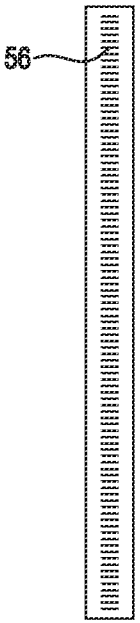
FIG. 22B is a schematic representation of a portion of the drive mechanism encased within the column having a plurality of teeth extending longitudinally therealong.
Figure 22A:
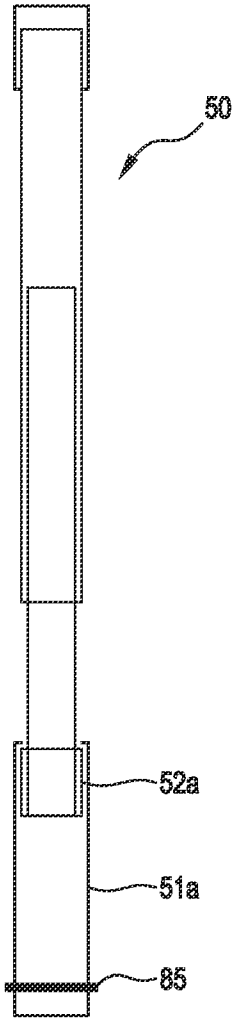
FIG. 22A is a cross sectional view of an embodiment of an extendable column, illustrating the outer and inner portions of the column separating to encase a drive mechanism therein.

The column 50 can be fabricated of two or more parts and in FIGS. 22A-B a three-part column 50 is illustrated with a third or central portion 53 formed as a post. The post 53 has slots/teeth/rack/receiving means 56 for a gear or a sprocket, (as schematically illustrated in FIG. 22C-E).

At a base of the first column portion 51, there is a bolt hole for receiving a locking bolt 85. This ensures that the second and third portions 52, 53 cannot fall through the end of the hollow first portion 51 in the collapsed configuration. The second and third column portions can be slotted at their respective bases to allow all three column sections to sit on the locking bolt 85 when the column is not in the extended, operable configuration.

In some embodiments the drive mechanism 58 is mounted, at least partially, within the column 50, such that a handle 59 can be inserted into the drive mechanism 58 from an exterior of the column 50 to activate the column 50 causing it to retract or extend. Preferably there is more than one location that provides access through the column 50 to allow the handle 59 to be repositioned or reconnected with alternative parts of the drive mechanism 58.

Alternatively, an external jacking system can be attached to the column 50 through an inspection hole/access opening that allows a gear (ratchet, worm drive, epicyclic gear set) to connect to the rack 56 of the third portion 53.

The column 50 can be jacked from the lower 51 or upper portion 52 of the column 50 using the third, centre portion 53 as the lifting or lowering device.

Alternatively, the raising of the completed, or partially completed structure 100, can be effected by way of columns, levers, pullies, cranes etc.

The preferred embodiments of the column 50 require no welding and can be extended to working height with minimal tools. Once at the desired height holes in the first second and third portions 51, 52, 53 of the column 50 are brought into alignment such that bolts can be inserted to align and restrain the column 50 in the extended configuration. These same bolts can be used to hold the column 50 in a compacted, transportable configuration within the kit 90.

Figure 21B:
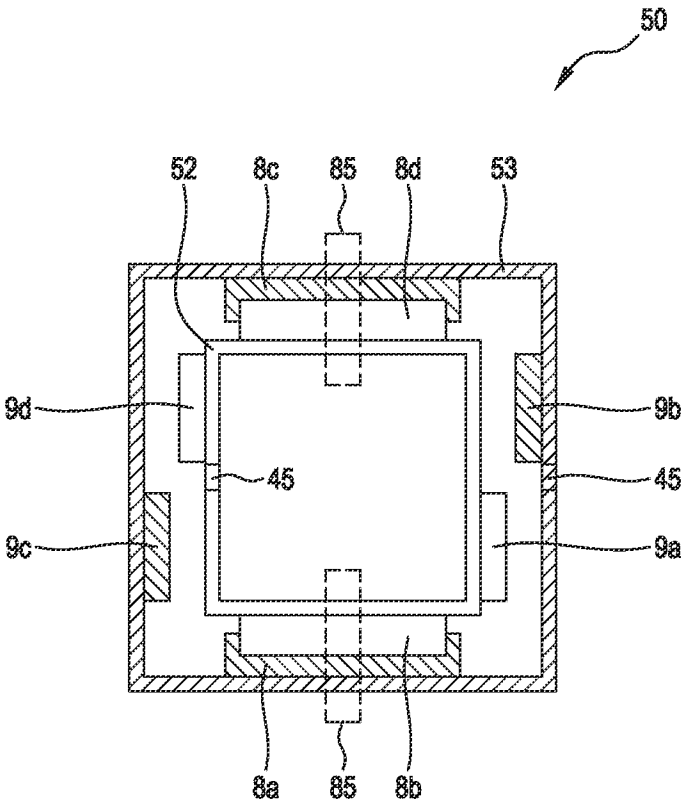
FIG. 21B is a cross-sectional view of the second and third column portions, illustrating the cooperating guide plates and alignment plates within the extendable column assembly.
Figure 21A:
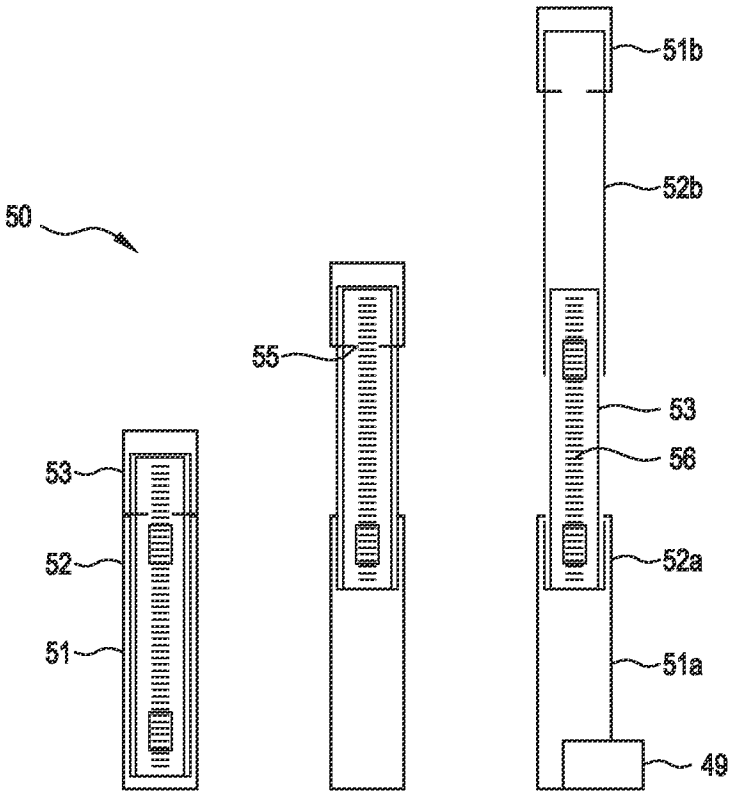
FIG. 21A is a schematic view illustrating internal portions of the extendable column in a transportable, partially extended and fully extended view, wherein a central member of the column provides a drive mechanism for extending the column in situ.

Column mounting plate 49 is schematically illustrated in FIG. 21A at the base of the column 50. The plate 49 is used to secure the column 50 to the first ladder frame 12 or the second ladder frame 14. The bracket 49 is a steel plate and can be welded or bolted to the adjoining structure of the chassis 10, 30.

FIG. 21B is a cross-sectional representation of the nesting of the second column portion 52 inside the section of the third column section 53.

In shaded section is the third column section 53 having four plates internally welded thereto. On opposing side of the interior section of the column 53, there is a pair of alignment plates 8*a*, 8*c*. The alignment plates 8*a*, 8*c* are affixed to a top portion of the section 53 and each provide bolt hole for receiving a locking bolt to hold the column in the extended configuration. As the second column portion 52 is drawn up and out of the third column portion 53 the alignment plates 8*a*, 8*c* are drawn toward a corresponding pair of alignment plates 8*b*, 8*d* which are affixed to a lower portion of the exterior of the second portion of the column 52. The corresponding pair of plates, 8*a*, 8*b* and 8*c*, 8*d* cannot pass each other and upon contact between the respective plate of each pair, provide a stop, such that the column portion 52 cannot be drawn entirely out of the column portion 53.

Figure 21C:
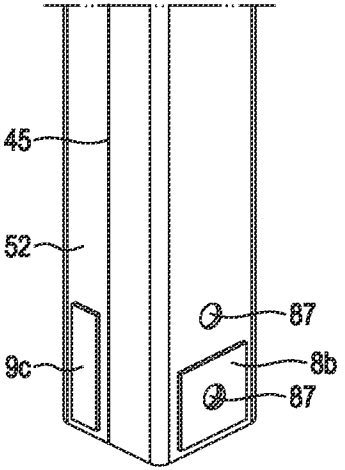
FIG. 21 C is a perspective view of the second and third column portions from FIG. 21B, un packaged from their nested configuration.
Figure 21C:
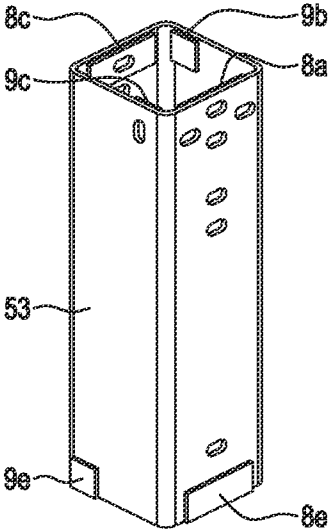

At the point of contact between plates 8*a*, 8*b* and 8*c*, 8*d* the locking bolt holes between the second and third column portions 52, 53 are also brought into alignment, ready to receive a locking bolt 85 (illustrated in dotted line in FIG. 21B). Although not illustrated a similar arrangement is provided between the first column portion 51 and the third column portion 53 (only alignment plate 8*e* is illustrated in FIG. 21C).

The column portions 51, 52, 53 can be formed from rolled sections and as such, as weld seam 5 is formed along the length of each column portion. As FIG. 21B is a schematic representation the column portions 52, and 53 have not been drawn to scale. In reality the weld seams 45 can protrude from the interior and/or exterior of the column section and cause the column portions to bind to one another. This can make extension of the column 50 cumbersome. To prevent or at least reduce this binding effect guide plates have been inserted on opposing sides of each weld seam 5.

On a first, external face of the column portion 53 a single guide plate 9*a* is affixed and on an opposing face of the column portion 53 is guide plate 9*c*, also affixed to the exterior of the column portion 53. Corresponding guide plates 9*b*, 9*c* are located on internal faces of the third column portion 53. As with the alignment plates 8*a*-8*d*, the corresponding guide plates 9*a*, 9*b* and 9*c*, 9*d* are located at opposing ends of the second and third column portions 52, 53 to form a guide way across the weld seams 45 therebetween.

In addition to providing alignment and reducing binding effects the combination of the guide plates 9*a*-9*d* and alignment plates 9*a*-9*d* also reduce the amount of play in the extended column 50, providing stiffness to the extended column 50 and maintaining a straight column. By locating corresponding plates 8, 9 at opposing ends of the two interrelated column portions 52, 53 the amount offset in the longitudinal axis of the extended column 50 is reduced.

Although not illustrated a similar arrangement of guide plates 9*a*-9*d* is provided between the first column portion 51 and the third column portion 53 (only guide plate 9*e* is illustrated in FIG. 21C).

Screw Pile Jack

In one aspect there is provided a self-jacking column 50 for engaging the column with a foundation, comprising:

a hollow support column 50;

a shaft 62 rotatably mounted within the support column 50; and a cutting member 66 engageable at a first end of the shaft 62, wherein rotating motion of the shaft 62 relative to the support column 50 drives the cutting member 66 into the foundation 73 thereby drawing the shaft 62 and attached support column 50 towards the foundation 73.

Figure 23B:
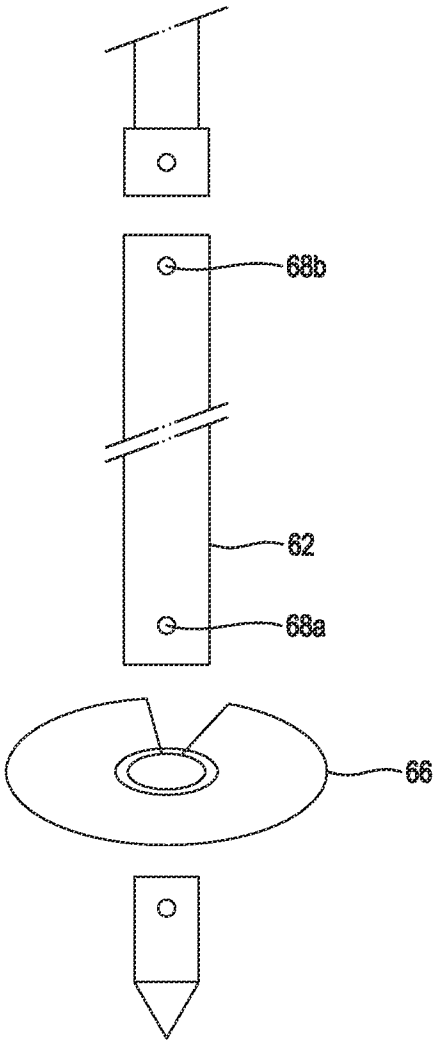
FIG. 23B is an exploded schematic view of the internal components of the self-screwing pile of FIG. 23A, illustrating an engageable blade located in proximity to the toe of the rotatable shaft.
Figure 23A:
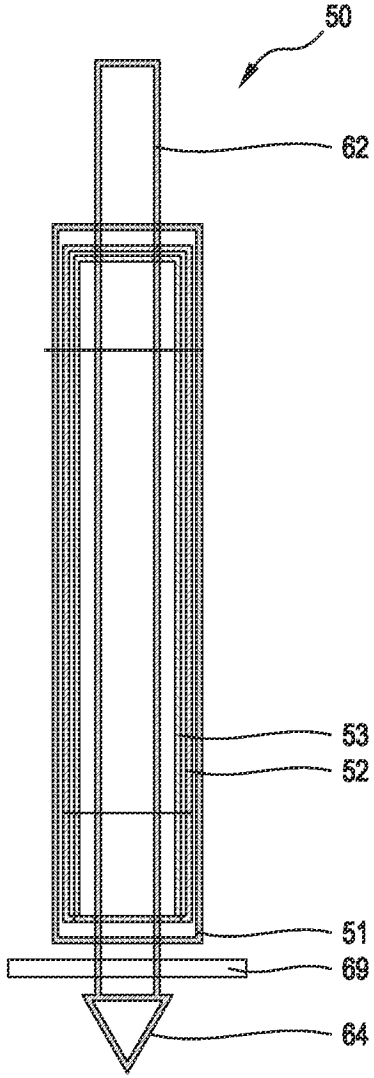
FIG. 23A is a cross sectional view of a self-screwing pile, illustrating a rotating shaft housed within the column to assist in engaging the columns with a foundation to which the structure is to be engaged.

FIG. 23A is a cross sectional view of a self-screwing pile, illustrating a rotating shaft housed within the column to assist in engaging the columns with a foundation to which the structure is to be engaged.

A screw pile can be incorporated into the column 50 using the column 50 as a sleeve or guide to install the pile 62. A gearing mechanism can be incorporated into the column 50 to screw and thereby insert the pile 62, winding it into a foundation to a predetermined depth.

The pile 62 is effectively a rotatable shaft that can be inserted into a hollow centre of the column 55 at which time a cutting member, such as a screw blade 66 can be attached to a lower part 62*a* of the shaft 62 at a base of the chassis 10. A bolt hole 68 can be cut into the shaft 62 for engaging the screw blade 66 thereto. The shaft 62 can extend above the column 50 where it can be driven by hand using a lever, driven by mechanical means such as a hydraulic, electric motor or other mechanism. A connecting aperture 68*b* can be provided in an upper portion of the shaft 62 for receiving a drive means.

FIG. 23B is an exploded schematic view of the internal components of the self-screwing pile of FIG. 23A, illustrating an engageable blade 66 located in proximity to a toe 64 of the rotatable shaft 62. The toe 64 assist in locating the pile 62 in the foundation to begin driving the shaft 62 into the foundation and will assist in stopping the shaft 62 from skating around on hard ground before finding purchase.

Seismic Connection

In one aspect there is provided an adjustable pile mount 70, comprising:

a load distribution member 74 having an aperture 72 therethrough and a substantially planar first surface;

a locking plate 75 having a substantially planar second surface, co-axially aligned with the load distribution member 74 and configured such that the planar first surface of the load distribution member is in contact with the planar second surface of the locking plate; and a connector 76 that engages the locking plate 75 to a pile 62 through the aperture 72 within the load distribution member 74, wherein tensioning the connector 76 draws the locking plate 75 towards the pile 62 and produces a clamping force between the locking plate 75 and the load distribution member 74 along a longitudinal axis of the connector 76, such that the load distribution member 74 is free to move relative to the conjoined pile 72, locking plate 75 and connector 76, in a plane that perpendicularly bisects the connector 76.

In providing a housing system that is focused on providing safe structures, many site locations will be disaster relief situations where the causes of natural disasters can be varied from storm, water and wind etc. damage including earthquakes, and often these risk areas include several of these factors. For this reason, our housing system is required to accommodate for as many of these risks as possible.

Piers and piles are an important element in resisting uploads as well as down loads and provide a rigid and secure base for a structure 100. When earthquakes occur, the ground moves and in part the amount that the ground moves will depend on the intensity of the earthquake as well as slippage of the ground due to landslides and liquefaction of the ground surface.

The ground movement is not typically limited to a single direction and will be a result of shifting in a vertical axis, up and down, and lateral movement. This lateral movement can shear piles and piers if not designed to bear these types of load.

One solution for allowing for horizontal movement to occur is by eliminating the bonding of the structure 100 to the ground with a membrane or smooth surface and a horizontal movement ability to the piers/piles. By providing this horizontal movement seismic shifts can occur below the building structure allowing the building to remain in a mostly static position and reduce the resultant damage.

By connecting the structure 100 to the piers/piles vertically and providing plates connected with openings to allow for movement in a horizontal direction some protection can be provided reducing the impact of an earthquakes ground movement. The size of the opening to allow for this movement can be increased or decreased and designed for the expected earthquake intensity and direction of shock waves (e.g. an earthquake may cause the ground at a location to oscillate by 200 mm).

Figure 24B:
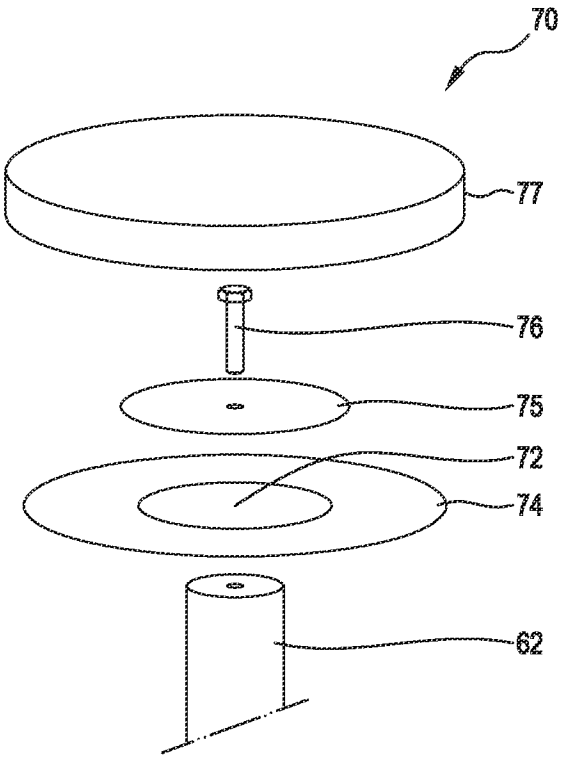
FIG. 24B is an exploded schematic view of the internal components of the adjustable pile mount of FIG. 24A, illustrating an opening through which the pile and structure are connected, wherein the opening defines the limit of allowable lateral movement between the two.
Figure 24A:
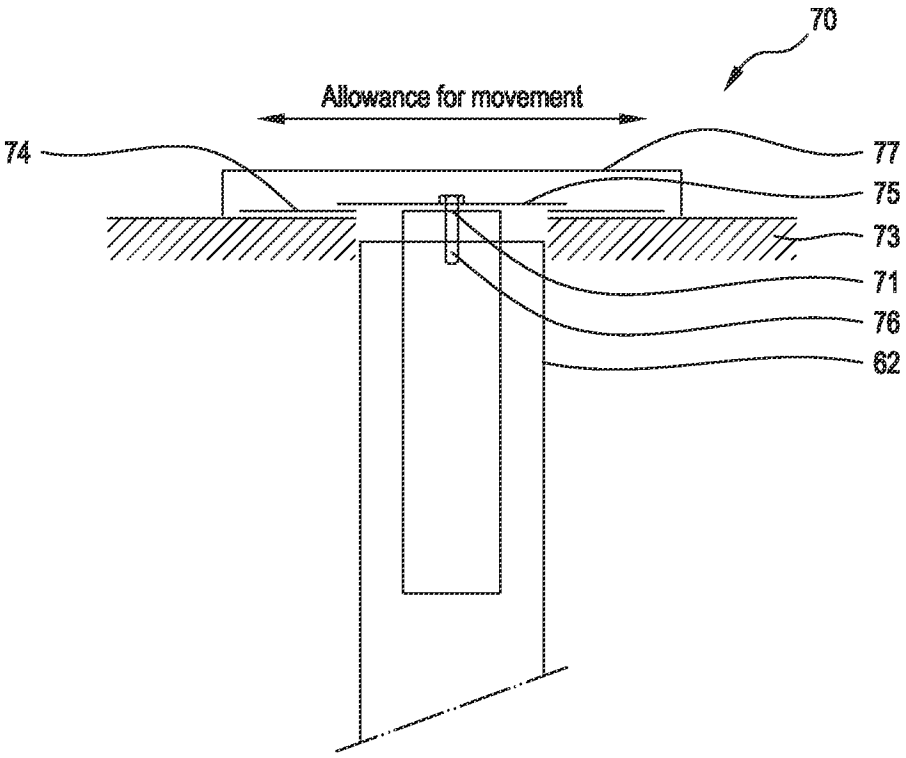
FIG. 24A is a cross sectional view of an adjustable pile mount, illustrating a laterally translatable interface between a pile and the structure.

FIG. 24A is a cross sectional view of an adjustable pile mount, illustrating a laterally translatable interface between a pile and the structure. Where FIG. 24B is an exploded schematic view of the internal components of the adjustable pile mount of FIG. 24A, illustrating an opening through which the pile and structure are connected, wherein the opening defines the limit of allowable lateral movement between the two.

In reference to FIG. 24A there is provided an adjustable pile mount 70, wherein:

1. the pile 62 has a connection point 71 at an uppermost portion thereof i.e. a top portion of the pile 62 that will be accessible after the pile has been driven into the foundation 73.
2. a load distribution plate 74 that can be connected to the foundation if required has an opening 72 in the centre that allows for movement.
3. A locking plate 75 is placed over the load distribution plate opening 72 and connected to the pile 62 with a connector such as a bolt 76 or other similar attachment.
4. A top cover 77 that allows the locking plate 75 to move freely below can either be a rigid member with a void or a soft foam to allow movement.
5. The load distribution plate 74 could also be connected to the building structure 100 above with the locking plate 75 held captive therein to provide an integrated unit.
6. A plurality of load distribution plates 74 can be combined in a laminated configuration (not illustrated) to allow additional movement and/or a tailored movement in multiple directions.

The dimensions of the aperture 72 (illustrated as a circular opening but not limited thereto) will limit the amount of lateral movement that the mount 70 can withstand before the connection between the structure 100 and the pile 62 becomes compromised. In some embodiments (not illustrated) the aperture 72 can be shaped and dimensioned to allow and restrict movement in predetermined directions.

Method of Erection/Installation

In one aspect there is provided a method of erecting a modular house 100 comprising a structural framework 80, the framework comprising an internal chassis 10 as a core structural element, the method comprising the steps:

(a) determining a configuration of modular house to be constructed;

(b) selecting an appropriate number of internal chassis 10 and external chassis 30 to provide sufficient structural support for the predetermined configuration of house to be erected; and (c) arranging and subsequently interconnecting each external chassis 30 to at least one internal chassis 10 using a plurality of cross-beams 38.

The method can further comprise at least one of the following steps:

(d) filing each first ladder frame 12 of each internal chassis 10 with a pourable substrate to form a structural floor to the modular house 100;

(e) affixing a roof panel 61 to each of the at least one internal chassis 10;

(f) extending a plurality of extendable columns 50, disposed between a lower ladder frame 12 and an upper ladder frame 14 of each internal chassis 10, to raise the upper ladder frame 14 to a predetermined height;

(g) affixing at least one exterior wall to the modular house 100;

(h) securing the plurality of extendable columns 50 into a foundation 73 of the modular house;

(i) filling each extendable column 50 with a pourable substrate; and (j) inserting a reinforcement mesh 16 into the first ladder frame 12, prior to prior to introducing the pourable substrate of step (d).

In some embodiment, the modular house may further comprise at least one of exterior walls and a roof supportable by the framework 80.

FIGS. 25A-H illustrate step-by-step a method of erecting a 3-bay house according to one embodiment of the invention.

FIGS. 25A and 25B—illustrate the kit 90 as received in transportable, retracted form. The kit 90 further comprises a plurality of cross-beams 38, peripheral frames 40 and reinforcement meshes 18, ready for construction.

FIG. 25C—illustrates the chassis 10 in a partially raised configuration where the third portion 53 of the extendable column 50 has been withdrawn from the second and first portions 52, 51.

FIG. 25D—illustrates the chassis 10 in a fully raised configuration where the second 52 and third portions 53 of the extendable column 50 have been withdrawn from the first portion 51.

FIG. 25E—illustrates the peripheral frames 40 and two reinforcement meshes 18 removed from the chassis 10 and laid out in preparation for erection. Where cranes and ladders are not readily accessible, it will be easier to move from FIG. 25C to FIG. 25G before raising the columns 50 to their full range, as the connections to roof components like gable beams 25 and C-purlins 15 can be engaged and secured before the chassis 10 is extended to full height.

FIG. 25F—illustrates the peripheral frames 40 in an upright configuration engaged with the reinforcement meshes 18, defining a foot print or usable floor area of the structure 100. The peripheral frames 40 are illustrated to have fixed height columns 57 that are not extendable as the columns 50 of the chassis 10.

Figure 25G:
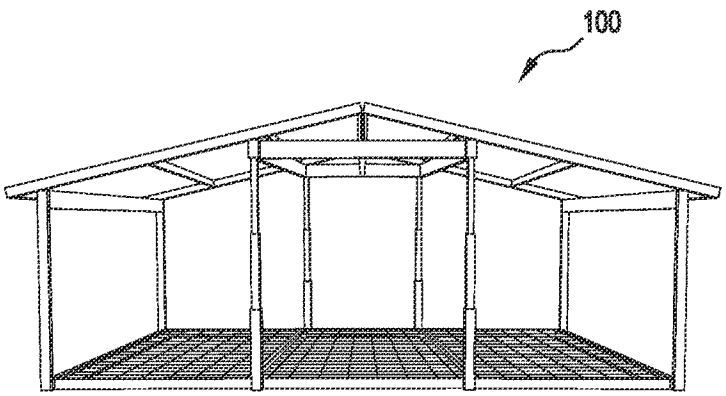

FIG. 25G—illustrates a front view of the structure 100, with the gable beams 25 and C-purlins 15 in place above the internal chassis 10 and external chassis 30.

Figure 25H:
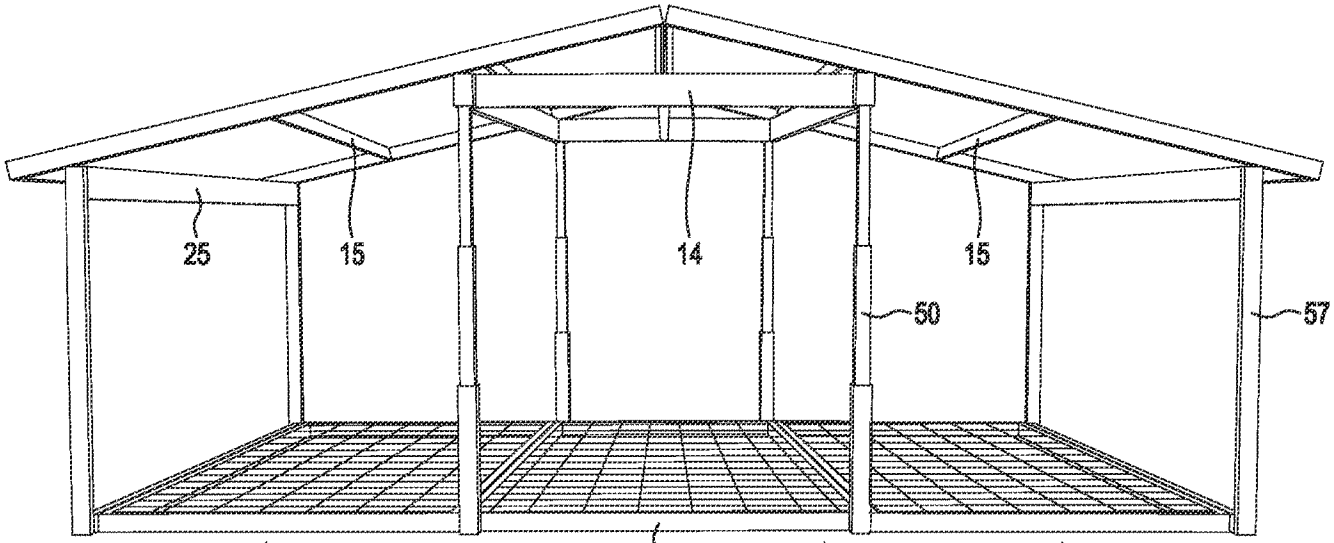

FIG. 25H—illustrates a perspective view of the structure 100 prior to the introduction of a pourable substrate over the reinforcement mesh panels 16 to form a floor slab. Up to this point the structure 100 is still relatively light and can be moved if necessary.

Figure 26A:
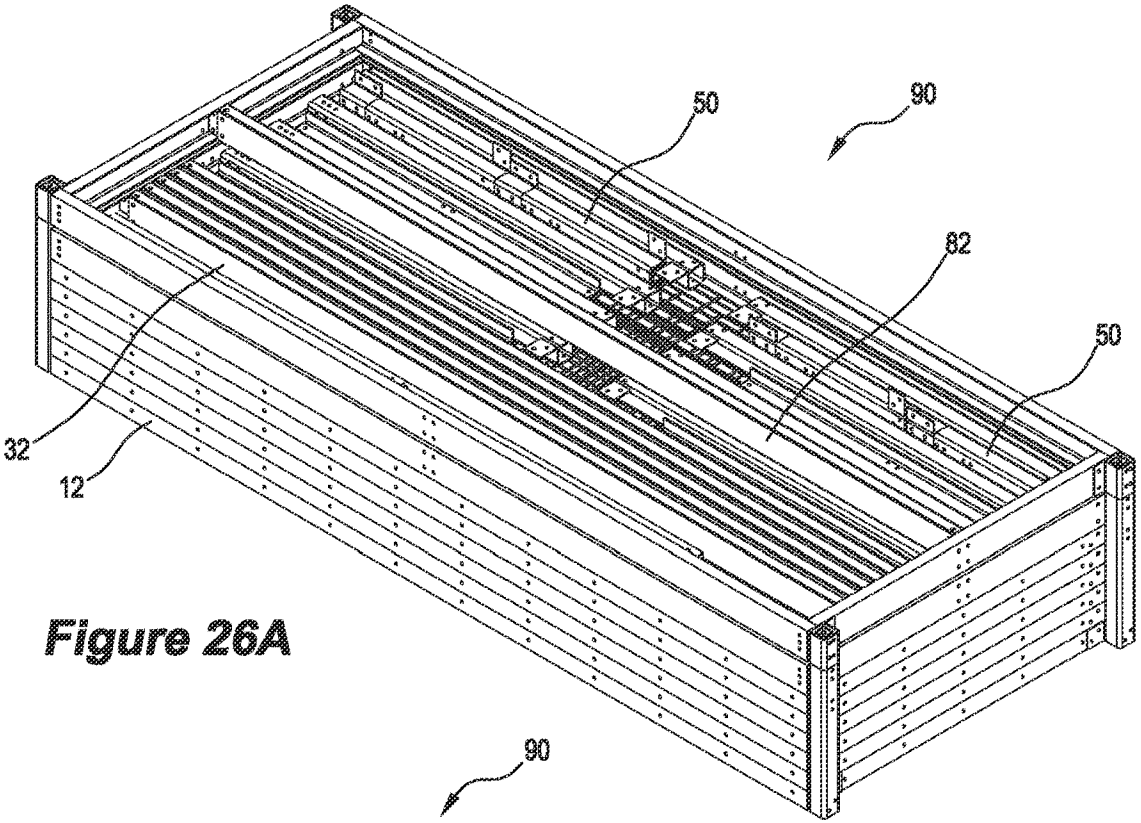
FIG. 26A-H illustrate step-by-step a method of erecting a 6-bay house according to one embodiment of the invention, including self-screwing piles for securement of the finished structure.

FIG. 26A—illustrates the kit 90 as received in transportable, retracted form. The kit 90 further comprises a plurality of cross-beams 38, peripheral frames 40 and reinforcement meshes 18, ready for construction. The kit 90 produces a structural formwork 80 that uses hinges to adjust the orientation of the second ladder frames 14 thereby eliminating the need for designated roof members 60, as the second ladder frames 14 substitute for designated roof members 60. Roof panels 61 can still be affixed to the roof member 60 in the form or panels or slats.

The entire kit 90 is dimensioned to fit into half of an ISO standard sized shipping container, allowing two kits 90 to be transported in the volume of a standard shipping container. All structural components are packaged for transport within the kit 90.

Figure 26B:
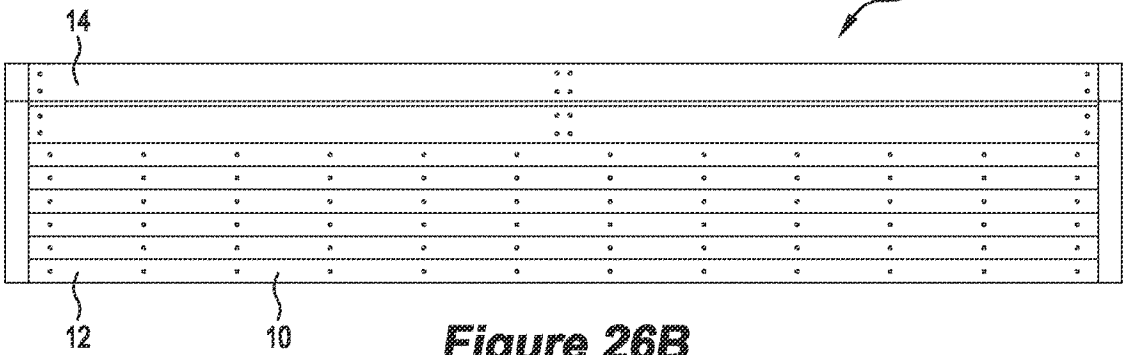
Figure 26C:
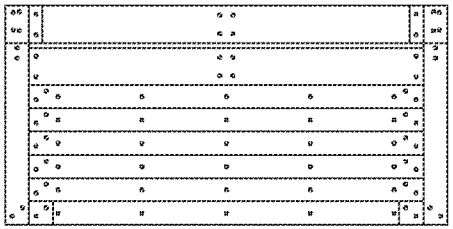

FIGS. 26B and 26C, respectively illustrate a side view and an end view of the kit 90.

Figures 26D, 26E, 26F:
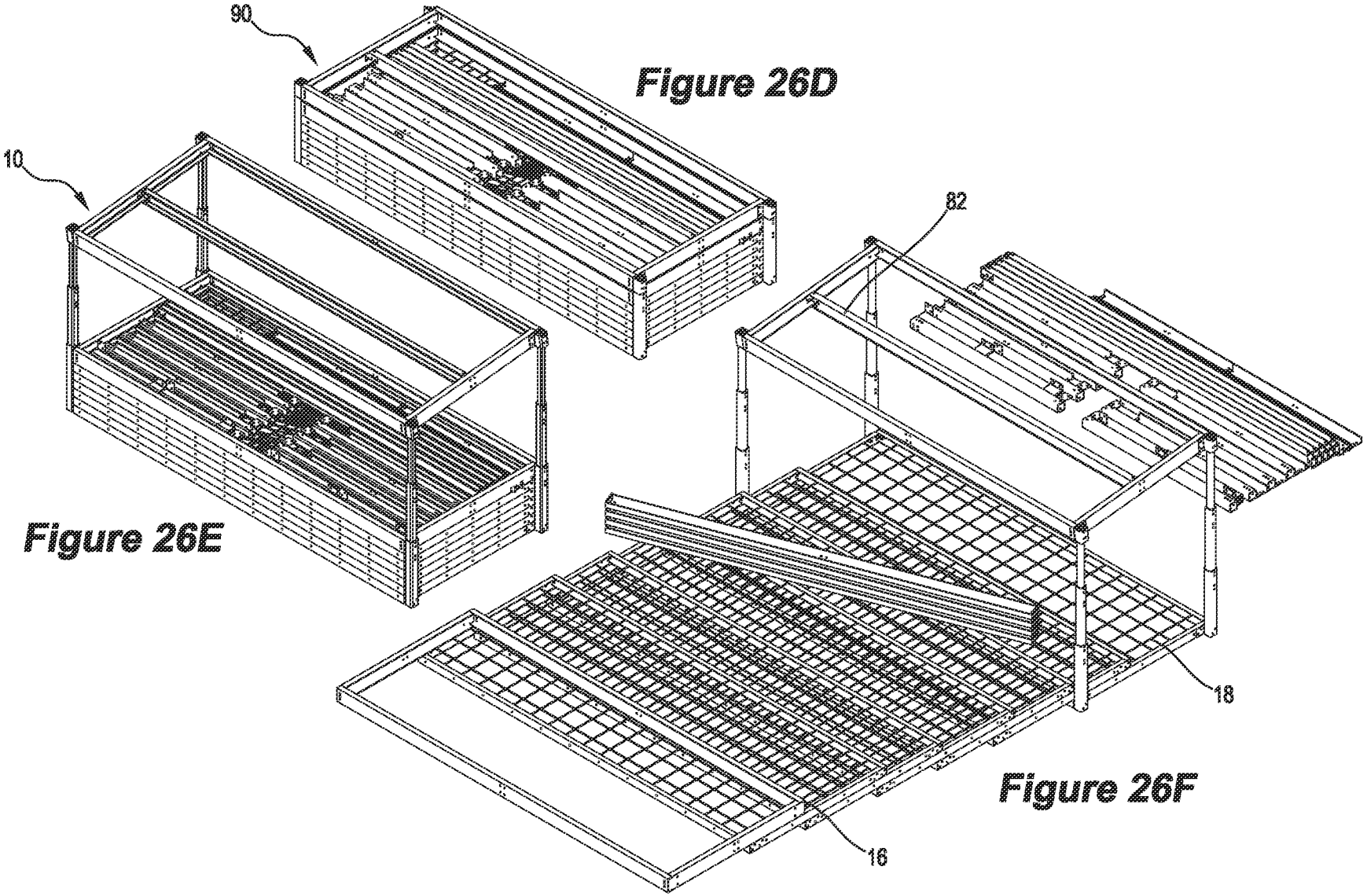

FIG. 26D—illustrates the chassis 10 in fully compacted configuration, while FIG. 26E illustrates a raised configuration where the third portion 53 and second portion 52 of the extendable column 50 have been withdrawn from the first portion 51.

FIG. 26F—illustrates the fully extended chassis 10 having the reinforcement mesh 18 extending across the first ladder frame 12. All other components of the kit 90 have been removed from the kit 90 in FIG. 26F and laid out in preparation for erection.

Figure 26G:
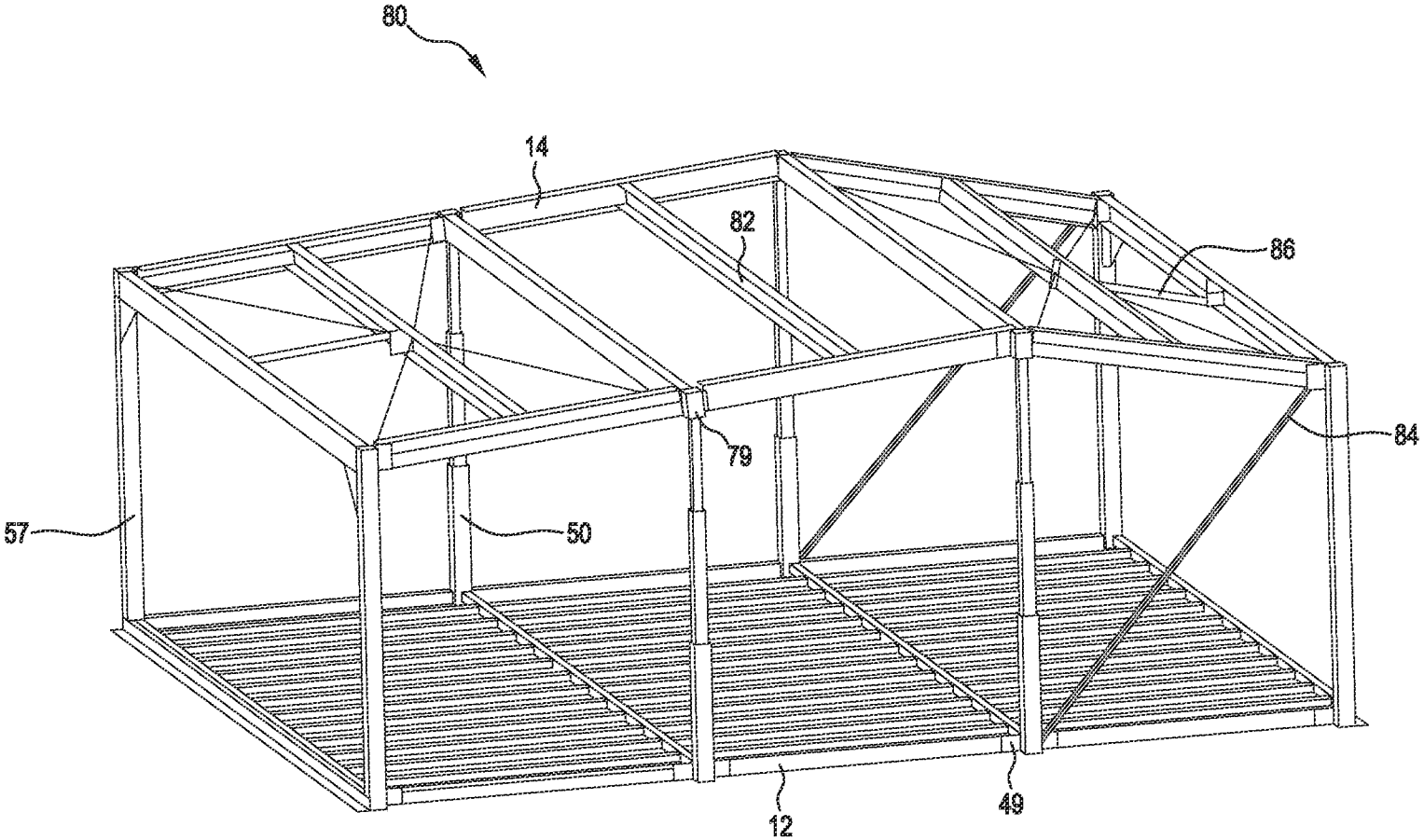

FIG. 26G—illustrates the peripheral frames 40 in an upright configuration engaged with the reinforcement meshes 18, defining a foot print or usable floor area of the structure 100. The peripheral frames 40 are illustrated to have fixed height columns 57 that are not extendable like the columns 50 of the chassis 10.

A central roof bar 82 extends approximately centrally of the second ladder frame 14, shown in FIG. 26G. This is an alternative embodiment of the second ladder frame 14, having a longitudinal bar, in preference to the cross-bars illustrated in for example, FIG. 2. A further roof strut 86 can also be incorporated into the roof structure, tying the central roof bar 82 to an upper portion of the peripheral frame 40.

FIG. 26G further illustrates a brace beam 84, that extends diagonally from the internal chassis 10 to the external chassis 30. The brace beam can extend diagonally from the first ladder frame 12 of the internal chassis upwards or can extend diagonally from the second ladder frame 14 of the internal chassis downwards (as shown in FIG. 26G).

Figure 26H:
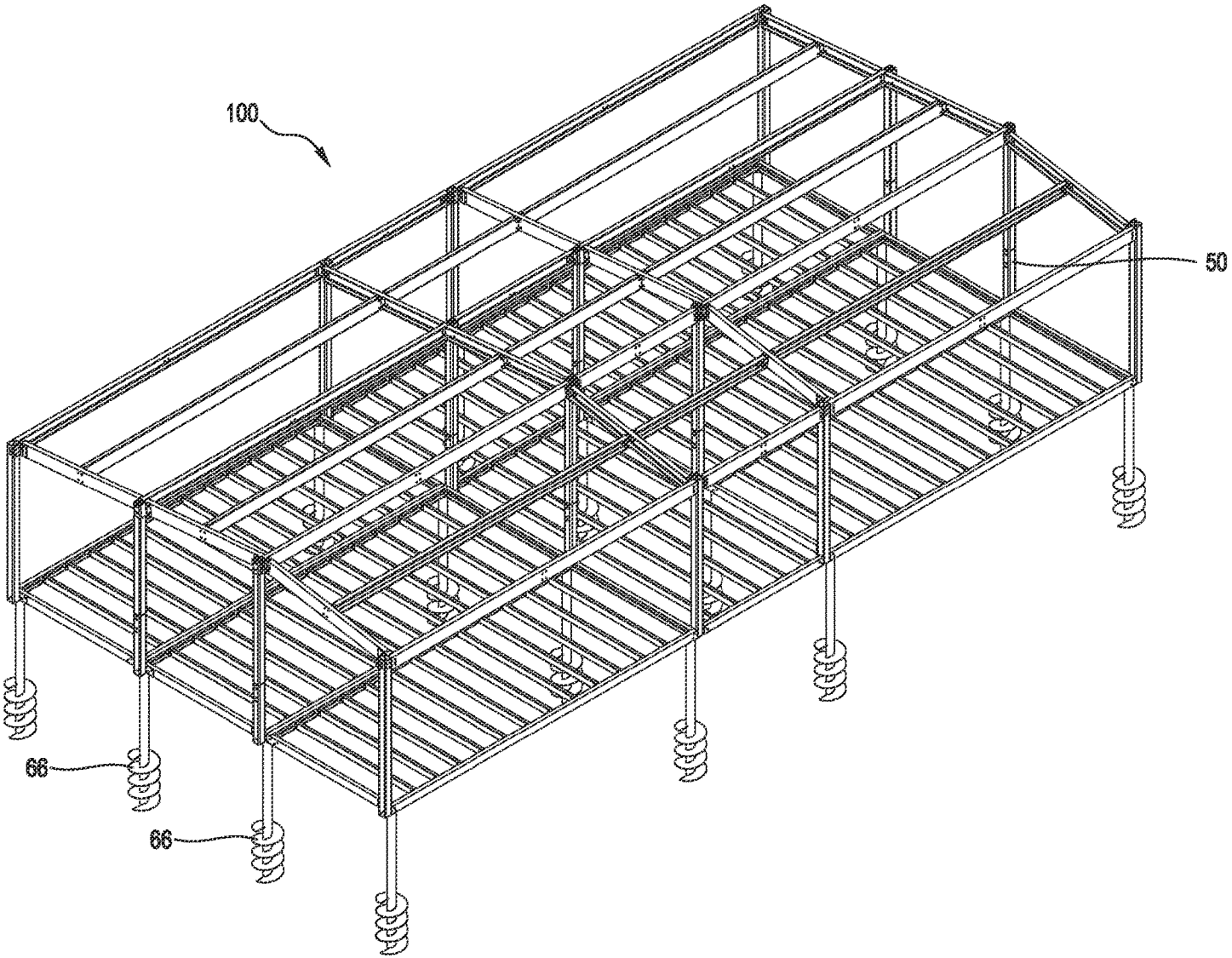

FIG. 26H—illustrates a perspective view of the structure 100 prior to the introduction of a pourable substrate over the reinforcement mesh panels 16 to form a floor slab. Up to this point the structure 100 is still relatively light and can be moved if necessary.

FIG. 26H further illustrates a plurality of cutting members 66 that extend into the substrate on which the structure is to be secured. As described herein, the cutting members 66 can be rotated from the substrate by manpower, to cut into the substrate thereby providing securement for the structure. While each column 50, 57 is illustrated in FIG. 26H to have a corresponding cutting member, this will not always be required. Where the is a low risk of movement, only selective columns may require securing into the substrate. In some circumstances, it is contemplated that no securement may be required, and in some cases no securement may be possible.

Figure 27:
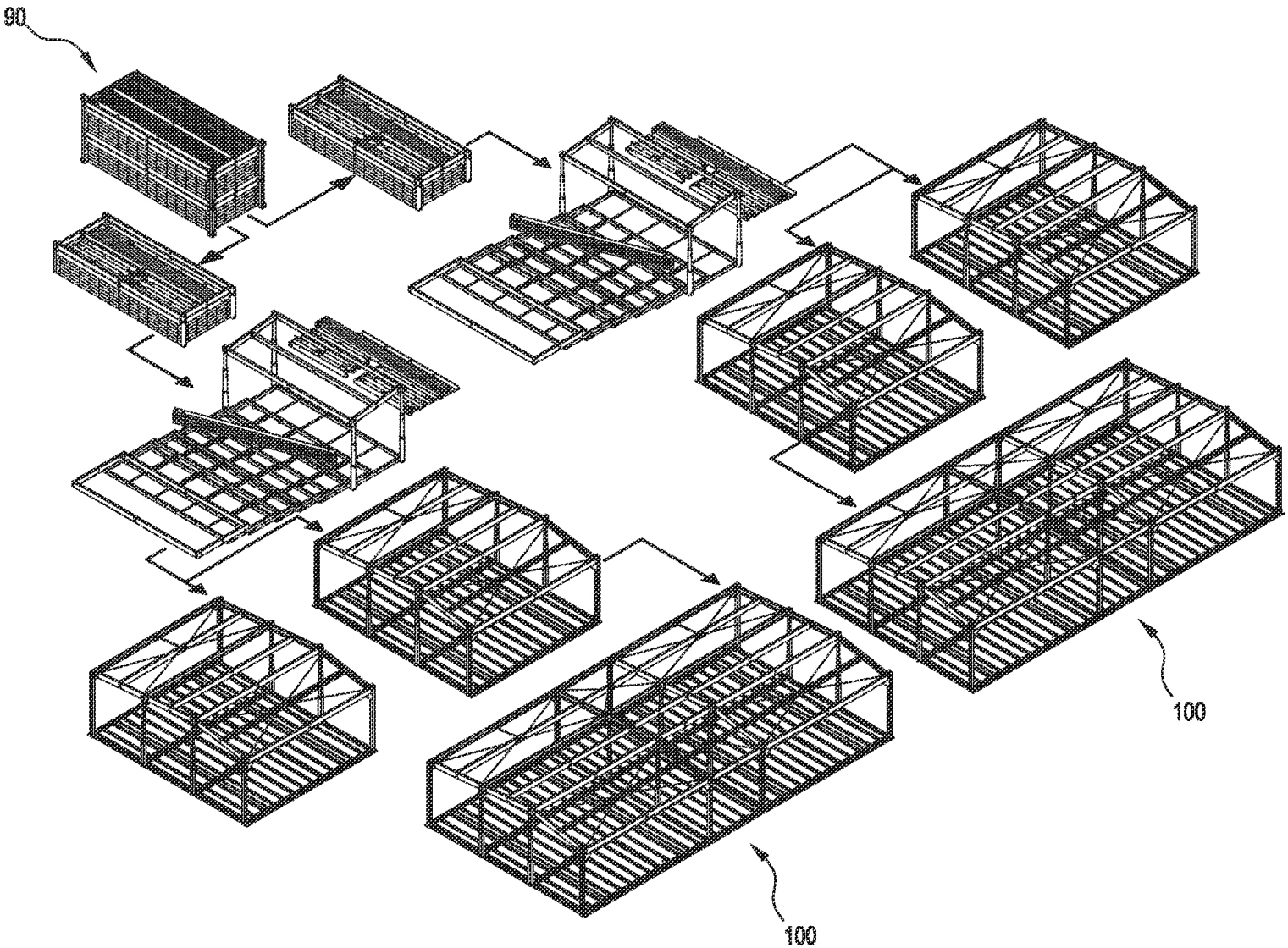
FIG. 27 illustrates schematically the entire build process from fully packaged product to fully configured house.

FIG. 27 illustrates schematically the entire build process from fully packaged product to fully configured structure.

The foundation 73 can be prepared for either a raised timber floor or a concrete slab, For raised floors screw piles provide an option that is fast. Advantageously, piles can be configured to resists cyclones and wild weather conditions.

For concrete slab structures 100, the following steps would be required:

Levelling and preparing the foundation 73 as would be done for a concrete pad.

Placing the internal chassis 10 in position.

Locating the reinforcement mesh panel 16 in position beside the internal chassis 10 and connect.

Installing screw piles 62 between the reinforcement mesh panels and connecting them together.

Installing the outriggers or peripheral frames 40.

If desired filling first ladder frame 12 and reinforcement mesh 18 therein with concrete.

Connecting roof C-purlins 15 and gable beams 25; or adjusting the orientation of the second ladder frames 14 to form the roof of the structure.

Installing roof sheets and gutters (not illustrated).

Raising columns 50 and roof structure to desired height.

Pouring concrete with roof over.

Affixing frame/clad, brick or other walls and continuing as per a normal construction.

It will be appreciated by persons skilled in the art that numerous variations and modifications may be made to the above-described embodiments, without departing from the scope of the following claims. The present embodiments are, therefore, to be considered in all respects as illustrative of the scope of protection, and not restrictively.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

| LEGEND | |
|---|---|
| No | |
| 3 | Forklift pockets |
| 5 | Brace beam of ladder frame |
| 6 | ISO Block |
| 7 | Weld line |
| 8 | Alignment plates |
| 9 | Guide plates |
| 10 | Internal Chassis |

-continued

| LEGEND | |
|---|---|
| No | |
| 11 | Double internal chassis |
| 12 | First Ladder frame |
| 13 | C-section beams |
| 14 | Second ladder frame |
| 15 | C-purlins |
| 16 | Inter. Ladder Frame |
| 18 | Reinforcement mesh |
| 19 | Outer frame |
| 20 | End Frame |
| 22 | End frame beams |
| 25 | Gable beam |
| 27 | Rafter battens |
| 30 | External Chassis |
| 32 | Upper Member |
| 34 | Lower Member |
| 36 | Intermediary Mbr |
| 38 | Cross-Beams |
| 40 | Peripheral Frame |
| 41 | Expandable Peripheral Frame |
| 42 | Hinge |
| 44 | First Pivot |
| 45 | Weld seam |
| 46 | Second Pivot |
| 48 | Hinge |
| 49 | Col. mount plat |
| 50 | Extendable column |
| 51 | First portion |
| 52 | Second portion |
| 53 | Third portion |
| 55 | Guide |
| 56 | Rack |
| 57 | Fixed height column |
| 58 | Drive mechanism |
| 59 | Handle |
| 60 | Roof frame |
| 61 | Roof panel |
| 62 | Rotating Shaft |
| 64 | Tip/Toe |
| 66 | Cutting member |
| 68 | Bolt hole |
| 69 | Mount plate |
| 70 | Pile mount |
| 71 | Connection point |
| 72 | Opening |
| 73 | Foundation |
| 74 | load distribution plate |
| 75 | Locking plate |
| 76 | Bolt |
| 77 | Cover |
| 78 | Bathroom module |
| 79 | Box Section Bracket |
| 80 | Structural Framework |
| 81 | Transport bolt hole |
| 82 | Roof Bar |
| 83 | C-Channel hinge |
| 84 | Brace beam |
| 85 | Transport bolt |
| 86 | Roof strut |
| 87 | Locking bolt hole |
| 90 | Transportable Kit |
| 92 | Floor |
| 93 | Floor boards |
| 94 | Top Hat Section |
| 95 | Tray |
| 100 | Modular House |
| P | Plane |

What is claimed is:

1. A modular housing system comprising a structural framework comprising an internal chassis as a core structural element, the internal chassis including:

a first ladder frame that defines a base; and a second ladder frame configured to support a roof, the second ladder frame being spaced from the first ladder frame via a plurality of columns to define a usable volume of the structural framework, at least two of the columns including an offset hinge arrangement for pivotal attachment of the second ladder frame thereto, wherein the offset hinge arrangement comprises a choice of pivot points offset from each other to facilitate multiple set angles of the second ladder frame relative to the first ladder frame.

2. The modular housing system of claim 1, comprising four columns engaged to the respective corners of the first ladder frame.

3. The modular housing system of claim 1, wherein a first pair of columns has a first length and a second pair of columns has a second length, the first length being greater than the second length to enable the modular structure to have a tilted roof profile.

4. The modular housing system of claim 1, wherein the structural framework further comprises an external chassis having:

a lower member and an upper member defining a plane;

a further pair of columns engaged with each of the lower member and upper member to form a peripheral frame; and a plurality of cross-beams perpendicularly bisecting the plane of the peripheral frame, wherein the peripheral frame is disposed apart from the internal chassis by the plurality of cross-beams, thereby increasing the usable volume of the structural framework.

5. The modular housing system according to claim 1, further framework comprising:

an intermediary ladder frame, engaged with the plurality of columns and disposed between the first ladder frame and the second ladder frame.

6. The modular housing system according to claim 1, wherein at least two of the plurality of columns are extendable columns having an adjustable length.

7. A method of erecting a modular structure, the method comprising the steps:

(a) receiving a kit comprising a first ladder frame to which a plurality of columns is pivotably coupled and a second ladder frame at a site location, wherein at least two of the columns include an offset hinge arrangement for pivotal attachment of the second ladder frame thereto;

(b) engaging the first ladder frame with a ground surface to provide a base of the structure;

(c) rotating the plurality of columns from a transport position in which each column extends parallel to the first ladder frame to an operative position in which each column is substantially perpendicular to the first ladder frame;

(d) raising the second ladder frame into position above the first ladder frame to provide a support for a roof of the structure; and (e) choosing a tilt angle of the roof by selecting one of two pivot points of the offset hinge arrangement to which the second ladder frame is pivotably connectable, the pivot points being offset from each other to facilitate multiple set angles of the second ladder frame relative to the first ladder frame.

8. The method of erecting a modular structure of claim 7, wherein at least two of the plurality of columns are extendable columns having an adjustable length, the method comprising the further step of:

(f) adjusting the length of the extendable columns to increase a usable volume of the modular structure.

9. A kit for forming a modular structure, comprising:

(i) a first ladder frame that defines a base of the modular structure;

(ii) a plurality of columns pivotably coupled to the first ladder frame; and (iii) a second ladder frame configured to support a roof of the modular structure, the second ladder frame being pivotably attachable to the first ladder frame via the plurality of columns;

wherein each of the columns is rotatable between a transport position in which each column is substantially parallel to the first ladder frame and an operative position in which each column is substantially perpendicular to the first ladder frame, and wherein at least two of the columns include an offset hinge arrangement for pivotal attachment of the second ladder frame thereto, the offset hinge arrangement comprising a choice of pivot points offset from each other to facilitate multiple set angles of the second ladder frame relative to the first ladder frame.

10. The kit of claim 9, wherein the plurality of columns comprises: a first pair of columns pivotably coupled to corners of a first end of the first ladder frame; and a second pair of columns pivotably coupled to corners of an opposing second end of the first ladder frame;

wherein the first pair of columns have a length greater than that of the second pair of columns, thereby providing the modular structure with a tilted roof profile.

11. The kit of claim 9, wherein at least two of the plurality of columns are extendable columns having an adjustable length.

12. The kit of claim 9, wherein when in the transport position, each of the columns is nested within a footprint of the first ladder frame.

13. The kit of claim 9, wherein the second ladder frame has the same external area as the first ladder frame.

14. The kit of claim 9, further comprising a pair of end frames configured to constrain the first and second ladder frames therebetween to facilitate transport thereof.

15. The kit of claim 14, wherein the end frames comprise ISO corner castings, the end frames having outer dimensions to match a standard ISO shipping container.

16. The kit of claim 14, wherein the end frames are configured to be incorporated into the modular structure, providing structural support thereto.

* * * * *